US005530528A

United States Patent [19]

Houki et al.

[11] Patent Number: 5,530,528

[45] Date of Patent: Jun. 25, 1996

[54] IMAGE FORMING APPARATUS HAVING CONTACT TYPE, ONE-COMPONENT DEVELOPING UNIT

[75] Inventors: Yoji Houki; Makoto Matsuoka; Takeo Kojima; Akira Takahashi, all of Kawasaki; Mitsuhito Furukawa, Ryouzen-machi; Hiroshi Kera, Fukushima, all of Japan

[73] Assignees: Fujitsu Limited, Kawasaki; Fujitsu Isotec Limited, Tokyo, both of Japan

[21] Appl. No.: 103,807

[22] Filed: Aug. 10, 1993

[30] Foreign Application Priority Data

Sep. 28, 1992 [JP] Japan ..... 4-257919
Sep. 28, 1992 [JP] Japan ..... 4-257927

[51] Int. Cl.[6] ..... G03G 15/08; G03G 21/00

[52] U.S. Cl. ..... 355/246

[58] Field of Search ..... 355/245, 246, 355/260

[56] References Cited

U.S. PATENT DOCUMENTS 4,999,676 3/1991 Mouri ..... 355/246

*Primary Examiner*—Fred L. Braun
*Attorney, Agent, or Firm*—Staas & Halsey

[57] ABSTRACT

An image forming apparatus having a developing unit for developing an electrostatic latent image on a photosensitive drum with a one-component toner, consisting of an endless latent image carrier; an image forming unit for forming an electrostatic latent image on the image carrier; a developing unit, for causing the developing roller to contact the image carrier to develop the electrostatic latent image on the image carrier; a mechanism for driving the developing unit; a toner sensor for detecting the presence/absence of the toner in the developing unit; and an abutting/detaching mechanism for abutting or detaching the developing roller of the developing unit on or from the image carrier. According to one aspect of this invention, this apparatus further has a controller for executing an image forming mode to control image formation in response to an image forming instruction, and a developer supply mode for, with the developing roller set apart from the image carrier, driving the driving mechanism to supply the toner to the developing roller in accordance with an output of the toner sensor indicating an insufficient amount of the toner.

23 Claims, 23 Drawing Sheets

IMAGE FORMING APPARATUS HAVING CONTACT TYPE, ONE-COMPONENT DEVELOPING UNIT

BACKGROUND OF THE INVENTION

Field of the Invention

The present invention relates to an image forming apparatus having a developing unit for developing an electrostatic latent image on a latent image carrier, and, more particularly, to an image forming apparatus having a contact type, one-component developing unit.

Description of the Related Art

Image forming apparatuses, such as a copying machine, a printer and a facsimile, employ a latent image forming type recording apparatus like an electrophotographing apparatus, due to recent demand for image recording on normal sheets of paper. According to this image forming principle, after a photosensitive drum as a latent image carrier is precharged, the photosensitive drum is exposed to a light image to have an electrostatic latent image formed thereon. This electrostatic latent image is developed by a developing unit so that a toner image is formed on the photosensitive drum. This toner image is then transferred onto a sheet of paper.

In such image forming apparatus, developing units that use a one-component developer, which contributes to designing an inexpensive developing unit, and whose maintenance is easy, are widely used. In particular, the one which uses a non-magnetic, one-component toner is receiving great attention. A developing unit using this non-magnetic, one-component toner can continue its developing action with a toner supplemented from a toner supplier. From the viewpoint of the reduction of running costs, it is advantageous to suspend the exchange of the toner supplier as long as possible.

The one-component developing unit is a contact type developing unit which causes the developing roller to contact the photosensitive drum. This developing unit performs a developing operation by electrostatically moving a toner, supplied by the developing roller, onto an electrostatic latent image on the photosensitive drum. As this developing roller contacts the photosensitive drum, it should have some elasticity. If this developing roller is always in contact with the photosensitive drum, it thermoplastically deforms. At times than the printing time, therefore, the developing roller is moved away from the photosensitive drum, thereby preventing the thermoplastic deformation of the developing roller.

Such one-component developing units are classified into two types. The first type requires the exchange of the developing unit itself when the internal toner runs out. The second type is supplied with a toner from an exchangeable toner cassette to ensure continuous toner supply.

In an image forming apparatus using such a developing unit, the developing unit is provided with a toner sensor for detecting if there is an insufficient amount of toner in the developing unit. When the toner sensor detects a toner-empty state, an operator is informed of the exchange of the developing unit or the exchange of the toner cassette. As shown in FIG. 1A, a contact type developing unit 5 has a storage room 89 for storing a toner and a developer room 88. In the developer room 88, a rotating paddle roller 83 stirs the toner and supplies it toward a reset roller 82, which supplies the toner to a developing roller 80. The layer of the toner on the developing roller 80 is supplied to the photosensitive drum (not shown) for image development after its thickness is restricted by a blade 81.

An agitator (paddle roller) 84 is provided in the storage room 89. As the agitator 84 rotates, it stirs the toner and supplies the toner to the developer room 88. Provided below this storage room 89 is a transmission photosensor 85 which includes a light-emitting element and a light-receiving element. The detection of a toner empty state is accomplished, considering that there is a toner while the toner sensor 85 is shielded from light by the toner, and that there is no toner (toner empty) when the shield is gone. More specifically, the toner empty detection is carried out in such a way that the output of the transmission photosensor 85 is integrated over time and it is determined as toner present if the integral value is equal to or above a set value and as toner empty if the integral value is less than the set value.

If the toner empty is detected, however, there is actually a certain amount of toner in the developing unit sufficient to print about a dozen sheets. The aforementioned exchange of the developing unit or the toner cassette upon the occurrence of the toner empty state thus shortens the exchanging cycle and increases the amount of the toner wasted. It is therefore a good idea to employ a method of instructing the exchange of the developing unit or the toner cassette when the toner in the developing unit actually becomes insufficient for any printing.

The prior art has two shortcomings. First, the image forming apparatus becomes ready to print when the aforementioned exchange is conducted, and executes a printing operation including development by the developing roller upon reception of a print instruction. When the printing state is disabled immediately after the exchange of the developing unit or toner cassette, there is an insufficient amount of the toner on the developing roller if the toner supply starts. Therefore, the developing roller should suffer an uneven amount of the toner for a certain period of time, resulting in image disturbance at the beginning of the printing. An insufficient amount of the toner on the developing roller means an insufficient amount of a fully charged toner, resulting in further image disturbance at the beginning of the printing.

Secondly, the conventional toner-empty detecting mechanism considers some margin in the detection of toner empty and generates a toner-empty signal accordingly. It is therefore difficult to detect the real toner insufficient state in the developing unit. This will be explained referring to FIGS. 1B and 1C.

When the amount of the toner is reduced, the fluidity increases. If the amount of the residual toner for the toner empty state is set small, a lump of the toner just before the transmission photosensor 85 may have different shapes, even with the same amount of the toner, as shown in FIGS. 1B and 1C so that the toner lump may or may not shield the transmission photosensor 85. This makes the accurate detection of toner empty difficult. Since one transmission photosensor 85 is used, if the photosensor 85 is damaged or stained, it would be reflected on the detection, thus making it difficult to accurately detect the toner empty state.

SUMMARY OF THE INVENTION

It is therefore a primary object of the present invention to provide an image forming apparatus which stably executes the initial development when a new developer is supplied.

It is another object of the present invention to provide an image forming apparatus which quickens the timing of starting image formation when a new developer is supplied.

It is a further object of the present invention to provide an image forming apparatus which stably performs development even when the developer supply falls short.

It is a still further object of the present invention to provide an image forming apparatus which can improve the accuracy of the detection of toner empty even when the amount of the residual toner for the toner-empty detection is set small.

To achieve the foregoing and other objects and in accordance with the purpose of the present invention, an image forming apparatus according to one aspect of this invention comprises an endless latent image carrier; an image forming unit for forming an electrostatic latent image on the latent image carrier; a developing unit having a developing roller for supplying a one-component toner to the latent image carrier and a supplying member for supplying the internal one-component toner to the developing roller, for causing the developing roller to contact the latent image carrier to develop the electrostatic latent image on the latent image carrier; a developing-unit driving mechanism for driving the developing unit; a toner sensor for detecting presence/absence of the one-component toner in the developing unit; an abutting/detaching mechanism for abutting or detaching the developing roller of the developing unit on or from the latent image carrier; and a controller for executing an image forming mode to control image formation by causing the abutting/detaching mechanism to abut the developing roller on the latent image carrier and driving the developing-unit driving mechanism in response to an image forming instruction, and a developer supply mode for, with the developing roller before accepting the image forming instruction, set apart from the latent image carrier, driving the developing-unit driving mechanism to supply the one-component toner to the developing roller in accordance with an output of the toner sensor indicating an insufficient amount of the toner.

In this aspect, when the controller detects an insufficient amount of a toner from the output of the toner sensor, the controller accepts the image forming instruction after driving the developing-unit driving mechanism to supply the toner to the developing unit while the developing roller is moved away from the latent image carrier. Accordingly, a sufficient amount of a toner is supplied to the developing roller. As the image formation is disabled until the toner on the developing roller becomes even, the toner on the developing roller becomes uniform by the time image information starts, thus providing a stable image in the initial image formation.

An image forming apparatus according to another aspect of this invention comprises an endless latent image carrier; an image forming unit for forming an electrostatic latent image on the latent image carrier; a developing unit having a developing roller for supplying a one-component toner to the latent image carrier and a supplying member for supplying the internal one-component toner to the developing roller, for causing the developing roller to contact the latent image carrier to develop the electrostatic latent image on the latent image carrier; a developing-unit driving mechanism for driving the developing unit; a toner sensor including a plurality of transmission photosensors provided below a storage room retaining the supplying member in the developing unit, for detecting presence/absence of the one-component toner in the developing unit; an abutting/detaching mechanism for abutting or detaching the developing roller of the developing unit on or from the latent image carrier; a discriminating circuit for discriminating toner empty from a sum of outputs of the plurality of transmission photosensors; and a controller for controlling the abutting/detaching mechanism and the developing-unit driving mechanism in response to an image forming instruction.

In the second aspect, a plurality of transmission photosensors are provided so as to detect the toner at a plurality of positions in the storage room, and toner empty is discriminated from the sum of the outputs of those transmission photosensors. It is therefore possible to stably generate an output corresponding to the amount of the toner regardless of a change in the shape of a lump of the toner having a fluidity and the movement of the toner. Even if some of the transmission photosensors are damaged or stained, the influence on the detection is reduced as compared with the use of a single transmission photosensor, so that toner empty can be detected reliably even when the amount of the toner is small.

Other features and advantages of the present invention will become readily apparent from the following description taken in conjunction with the accompanying drawings.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENT

Figure 1A:
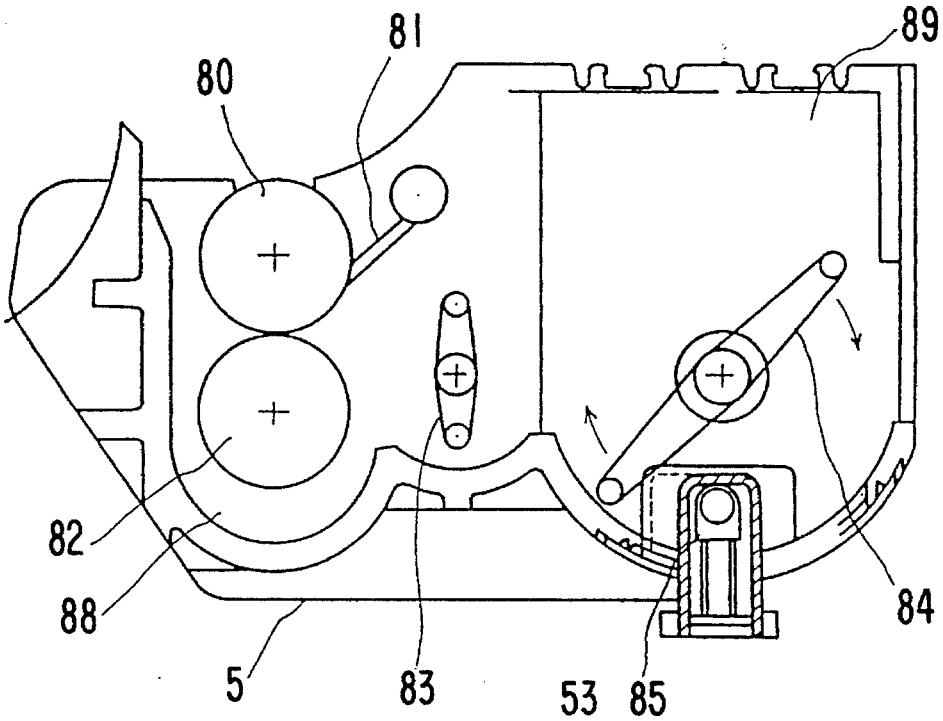
FIG. 1A PRIOR ART
FIGS. 1A, 1B and 1C are diagrams showing prior art.
Figure 1B:
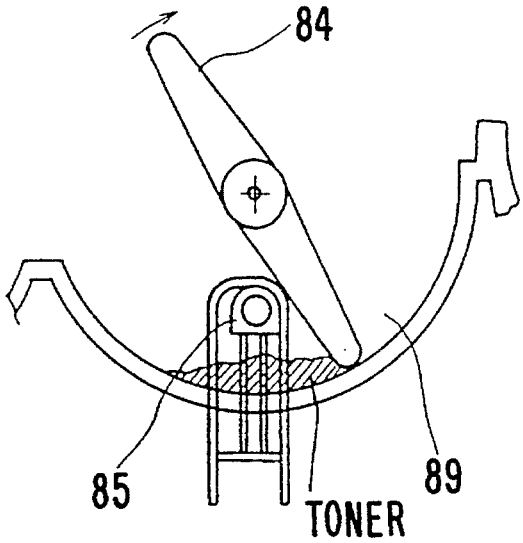
FIG. 1B PRIOR ART
Figure 1C:
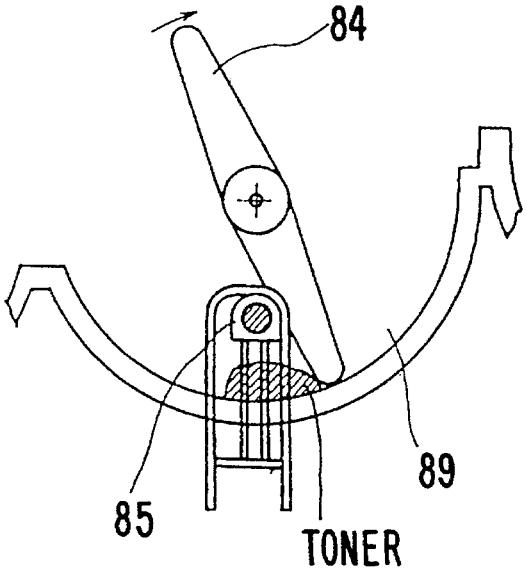
FIG. 1C PRIOR ART
Figure 2:
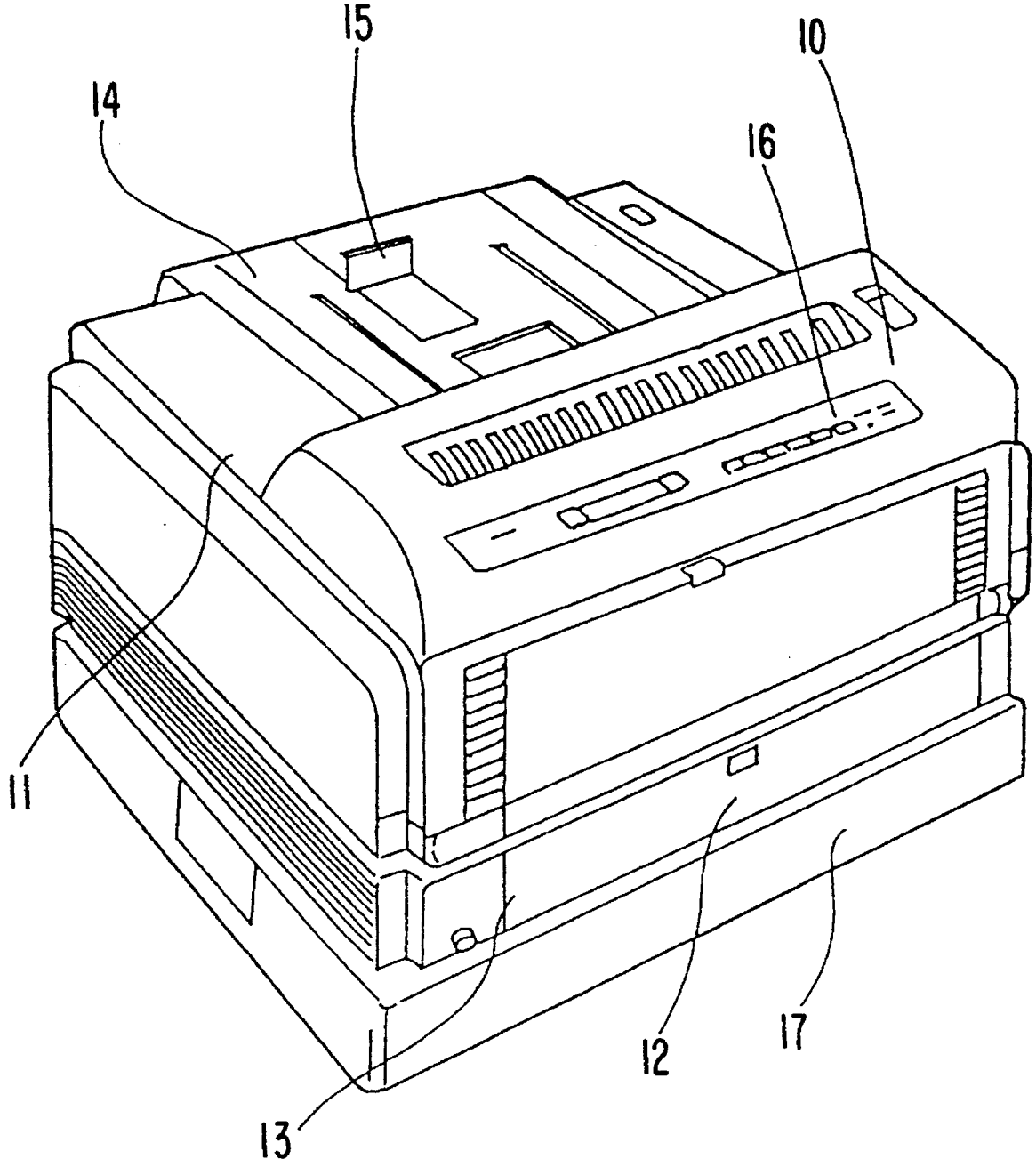
FIG. 2 is a perspective view showing the outline of an image forming apparatus according to one embodiment of the present invention.

The illustrated image forming apparatus is an electrophotographic printer; FIG. 2 is a perspective view of the apparatus as viewed from the front. In FIG. 2, a front cover 10 is opened frontward of the apparatus to open a feeding path 3 shown in FIG. 3. An upper cover 11 covers the top of the apparatus, and is opened upward of the apparatus. When opened, the upper cover 11 opens the top of the apparatus. A sheet cassette 12 is set in the apparatus from the front thereof through a cassette inserting port 13. A stacker 14 is provided at the top of the apparatus to receive printed sheets. A sheet guide 15 is provided on the stacker 14 to guide the sheet discharged on the stacker. An operation panel 16 is provided at a front cover 10 and has various switches and a display unit. A controller box 17 is provided at the bottom of the apparatus and accommodates printer control circuits, etc.

Figure 3:
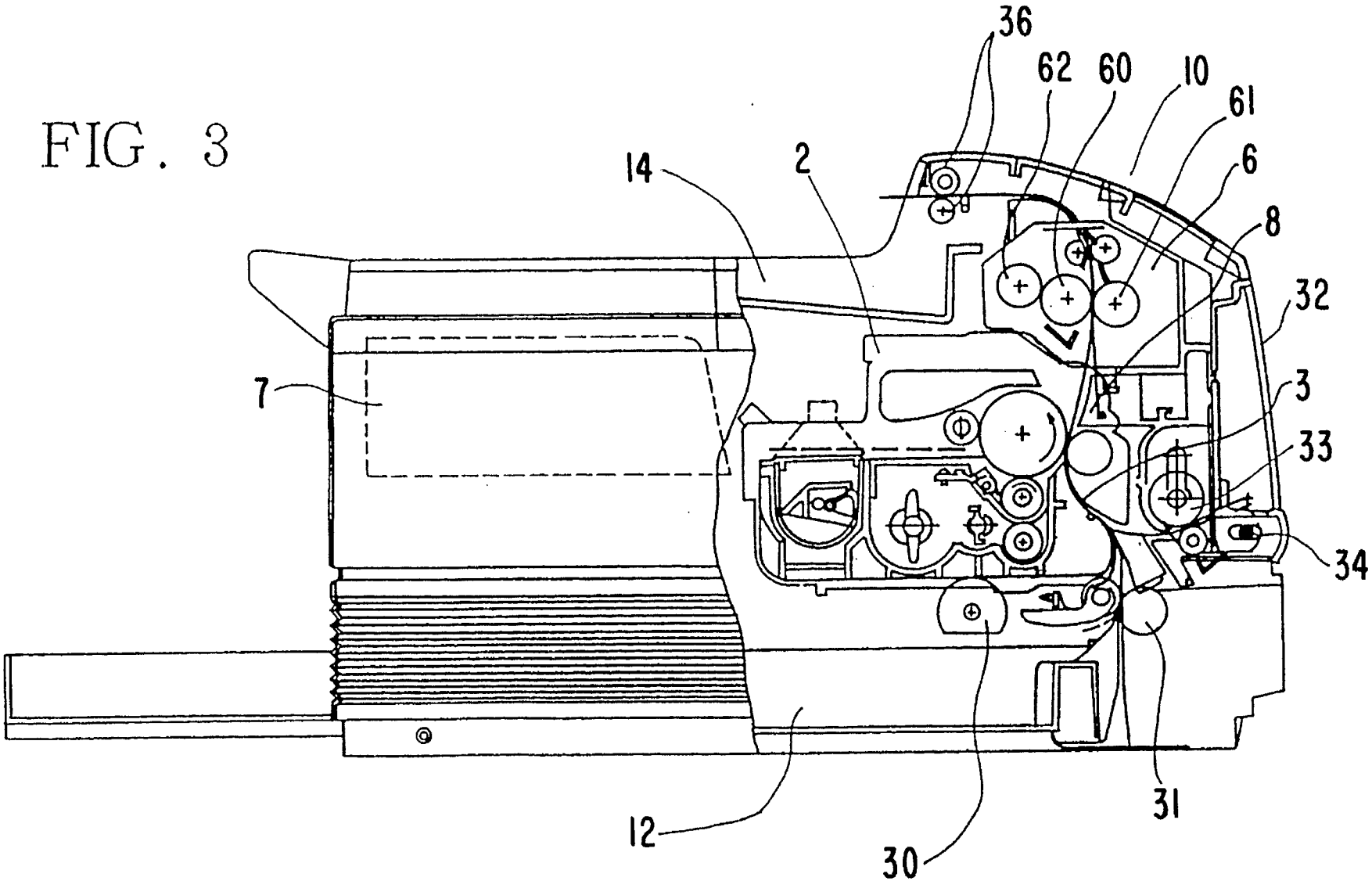
FIG. 3 is a cross-sectional view of the interior of the image forming apparatus shown in FIG. 2.

Referring to the cross-sectional view in FIG. 3, an electrophotographic process cartridge 2 is provided above the sheet cassette 12 and will be described later with reference to FIG. 4. A thermal fixing unit 6 causes a sheet to be put through between a heat roller 60 and a backup roller 61 to fix a toner image on that sheet. This thermal fixing unit 6 is provided with a cleaning roller 62 for removing a toner from the heat roller 60. An optical unit 7 uses a polygon mirror to scan the photosensitive drum 40 with a beam from a semiconductor laser, which is driven according to image information, thereby writing an image on the photosensitive drum 40. The light image from the optical unit 7 passes above a developing unit 5 (which will be described referring to FIG. 4) of the process cartridge 2 as indicated by a broken-lined arrow to irradiate the photosensitive drum 40 of the process cartridge 2. A sheet separator 8 has a discharge electrode to apply charges of the opposite polarity to that of the potential at the back of the sheet on which the toner image on the photosensitive drum 40 has been transferred, to that back of the sheet to deelectrify the back of the sheet. This discharge electrode deelectrifies the back of the sheet to separate the sheet from the photosensitive drum 40.

A pickup roller 30 serves to pick up sheets in the sheet cassette 12. A resist roller 31 aligns the leading edge of the sheet picked up by the pickup roller 30, and feeds out the sheet. Reference numeral 32 denotes a manual-insertion guide which guides a manually inserted sheet to a feed roller 33 when opened rightward in FIG. 4. The feed roller 33 feeds the sheet, guided by the manual-insertion guide 32, toward the photosensitive drum 40 of the process cartridge 2. Reference numeral 34 is the rotary shaft of the front cover 10. Discharge rollers 36 are provided at the top portion of the front cover 10 to discharge the sheet, passing through the thermal fixing unit 6, onto the stacker 14.

Figure 4:
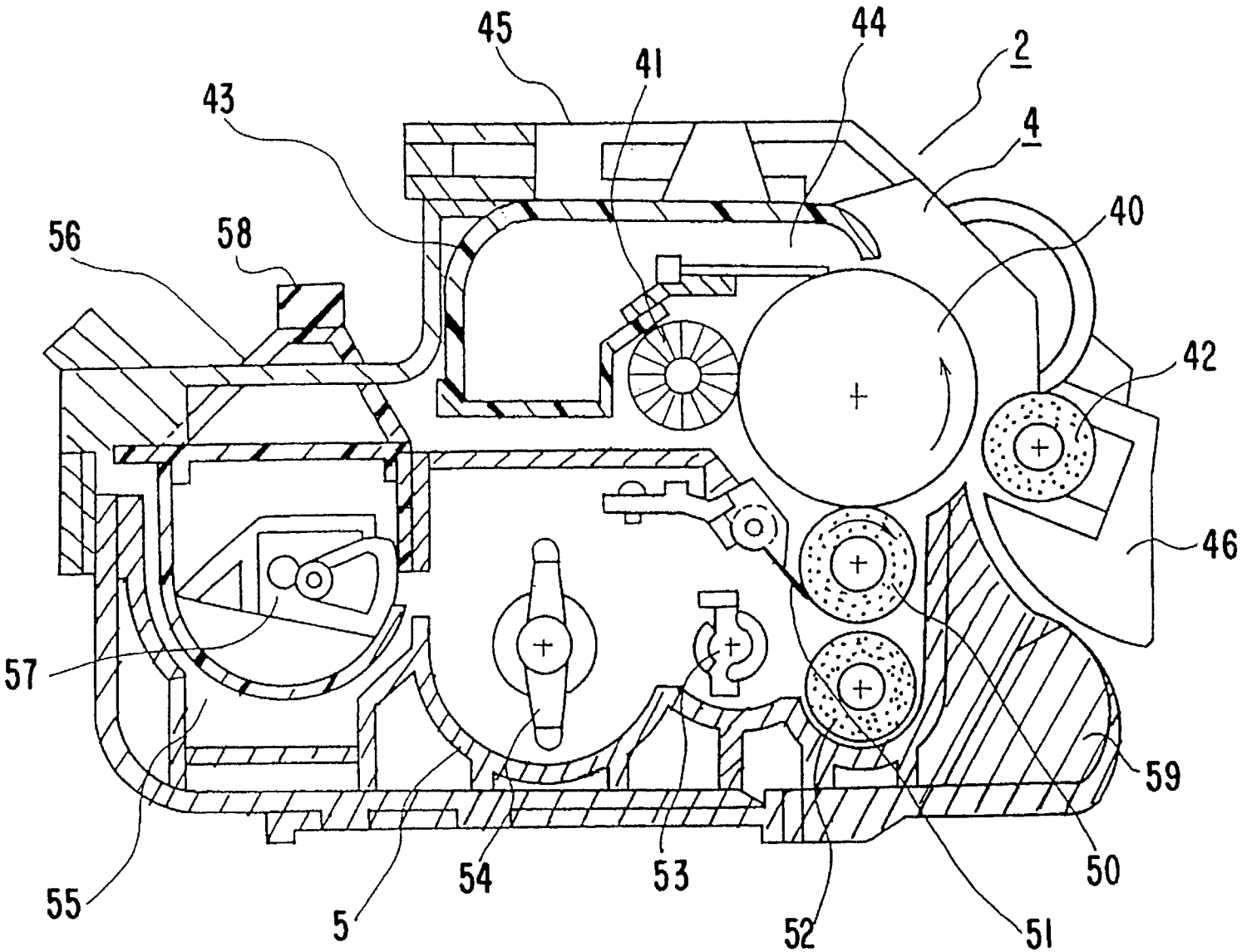
FIG. 4 is a cross section of a process cartridge of the image forming apparatus shown in FIG. 3.

As shown in the cross-section view in FIG. 4, the process cartridge 2 consists of a drum cartridge 4 and the developing unit 5. The developing unit 5 is attached to the drum cartridge 4 by pins (not shown), and can be separated therefrom by detaching the pins.

The structure of the drum cartridge 4 will now be described. In FIG. 4, the photosensitive drum 40 has an organic photosensitive layer (OPC or the like) formed on the surface of a cylindrical base of aluminum or the like, and is rotatable counterclockwise as shown. A brush charger 41 is constituted by winding a conductive brush, which has conductive rayon fibers woven into the core, around the rotary shaft. The photosensitive drum 40 is uniformly charged to about −600 V by this brush charger 41. A transfer roller 42 is provided at the drum cartridge 4, and is made of a conductive porous rubber material, such as porous polyurethane foam (sponge). This transfer roller 42 is applied with a transfer voltage and is pressed against the photosensitive drum 40 to transfer the toner image on the photosensitive drum 40 onto the sheet. A waste toner box (cleaner) 43 is provided with a scraping blade 44, which scrapes the residue toner off the photosensitive drum 40, so that the box 43 receives the scraped toner. A handle 45 is provided to permit a user to carry the drum cartridge 4 with the hand. A roller cover 46 serves to be a stopper for the transfer roller 42 and to protect the transfer roller.

The structure of the developing unit 5 will be described next. Referring to FIG. 4, a developing roller 50 is a conductive elastic roller, which is preferably made of a conductive porous rubber material, such as conductive porous polyurethane foam (sponge). The developing roller 50 rotates clockwise as shown in the diagram to feed a non-magnetic, one-component toner to the photosensitive drum 40 while holding the toner with the retentive force of its surface. This developing roller 50 is pressed against the photosensitive drum 50 with a predetermined nip width and is applied with a developing bias voltage of about −300 V. A layer-thickness restricting blade 51, which is made of a 0.1-mm thick stainless plate, serves to restrict the thickness of the toner layer on the developing roller 50 to a predetermined thickness. This layer-thickness restricting blade 51 is pressed against the developing roller 50 and is applied with a negative voltage of about −400 V. This applied voltage allows the layer-thickness restricting blade 51 to supply negative charges to the toner to forcibly charge the toner negatively at the time of restricting the thickness of the toner layer. Accordingly, the toner can be charged stably even under conditions of high humidity and high temperature. A reset roller 52 is disposed to face the developing roller 50 and rotates in the same direction as the developing roller 50. This reset roller 52 is applied with a bias voltage of −400 V to scrape the toner off the developing roller 50 in the right-hand side of the diagram and to supply the toner to the developing roller 50 in the left-hand side of the diagram.

Reference numerals 53 and 54 denote paddle rollers, which rotate to stir the non-magnetic, one-component toner in the developing unit 5 and charge the toner. In addition, the paddle rollers 53 and 54 supply the stirred toner toward the reset roller 52. A toner cassette retainer 55 retains a toner cassette 56, which contains the non-magnetic, one-component toner. This toner cassette 56 is detachably set in the toner cassette retainer 55. A toner supply lever 57 is provided in the toner cassette 56, and rotates to feed the toner in the toner cassette 56 into the developing unit 5. The toner cassette 56 is provided with a handle 58 to allow a user to hold the toner cassette 56 with a hand. A sheet guide rib 59 is provided below the roller cover 46. This sheet guide rib 59, together with the roller cover 46, forms a path for guiding the sheet between the photosensitive drum 40 and the transfer roller 42.

A toner sensor 9 is located under the paddle roller 54 and on the apparatus side to optically detect the presence/absence of the toner. A U-shaped feeding path 3 is formed, which extends from the sheet cassette 12 and reaches the discharge rollers 36 through the process cartridge 2.

The function of this printer will be described referring to FIGS. 2 through 4. A sheet in the sheet cassette 12 is picked up by the pickup roller 30 and abuts against the resist roller 31. After the leading edge is aligned by the resist roller 31, this sheet is fed toward the photosensitive drum 40 along a U-shaped feeding path 3. Meantime, when the picked sheet reaches the resist roller 31, the optical unit 7 starts exposing the photosensitive drum 40 to image light. As a result, the potential of the image-exposed portion of the photosensitive drum 40, which has been charged to −600 V by the brush charger 41, becomes zero, thus forming an electrostatic latent image corresponding to the image to be copied.

As a bias voltage of −300 V is applied to the developing roller 50 in the-developing unit 5, the negatively charged toner sticks on the image-exposed portion of zero potential of the photosensitive drum 40, forming a toner image thereon. The toner image on the photosensitive drum 40 is transferred onto the sheet, fed by the resist roller 31, by the transfer roller 42 due to the electrostatic force and pressure. The back of the sheet that is electrostatically adsorbed to the photosensitive drum 40 is deelectrified by the charges supplied by the sheet separator 8, so that this sheet is separated from the photosensitive drum 40. The separated sheet is fed to the thermal fixing unit 6 where the toner image on the sheet is thermally fixed by the heat roller 60. The image-fixed sheet is then discharged on the stacker 14 by the discharge rollers 36.

A sheet manually inserted through the manual-insertion guide 32 pulled open is likewise conveyed toward the photosensitive drum 40 by the feed roller 33. The toner image on the photosensitive drum 40 is transferred onto that sheet by the transfer roller 42 due to the electrostatic force and pressure. The back of the sheet that is electrostatically adsorbed to the photosensitive drum 40 is deelectrified by the charges supplied by the sheet separator 8, so that this sheet is separated from the photosensitive drum 40. The separated sheet is then fed to the thermal fixing unit 6 where the toner image on the sheet is thermally fixed by the heat roller 60. The resultant sheet is then discharged on the stacker 14 by the discharge rollers 36.

Figure 5:
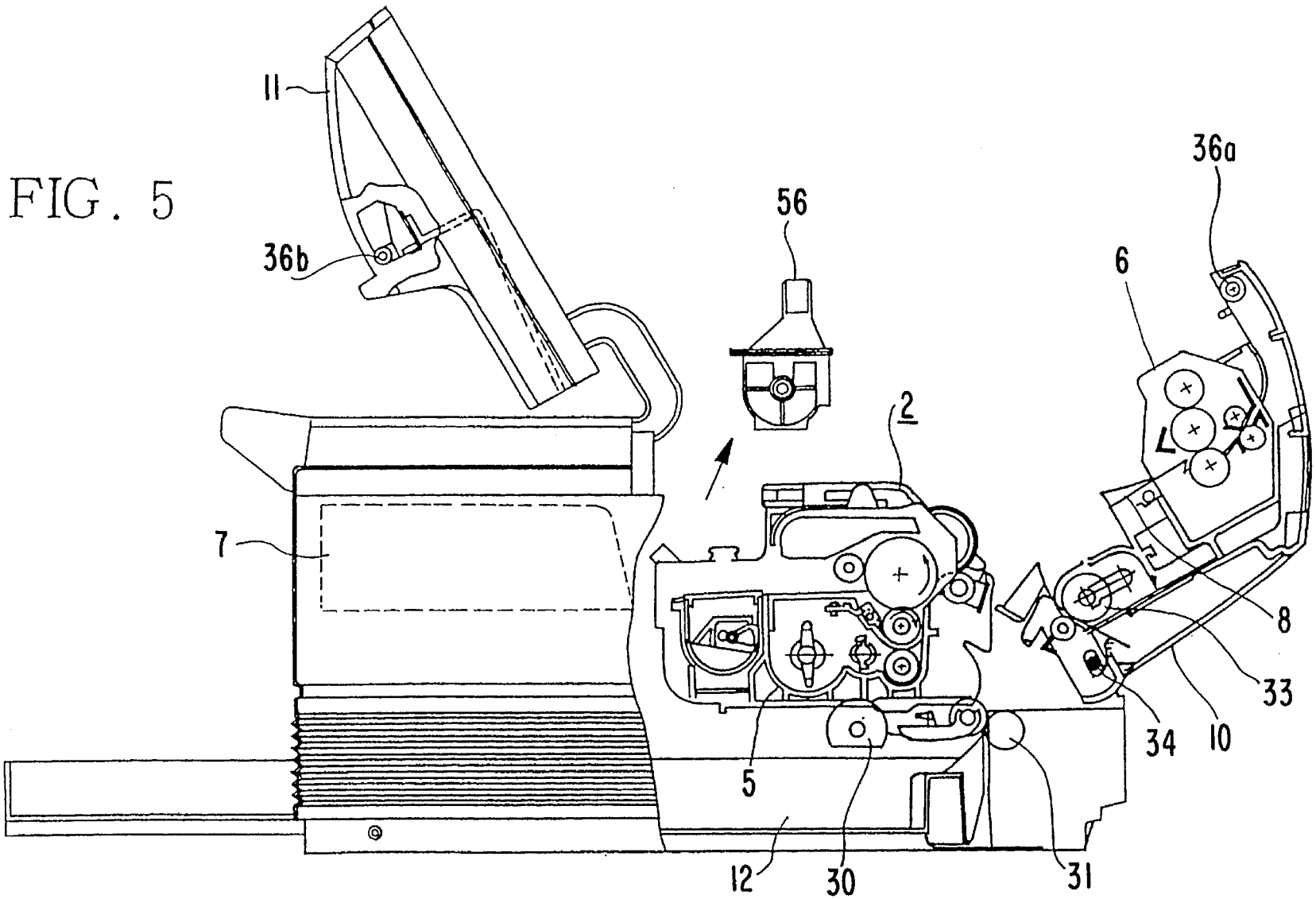
FIG. 5 is a diagram illustrating the image forming apparatus of FIG. 3 with its covers open.

In the diagram of FIG. 5 which illustrates the front cover and upper cover of the apparatus opened, the front cover 10 is opened frontward (rightward in the diagram) around the cover rotary shaft 34. Provided on this front cover 10 are the manual-insertion guide 32, the feed roller 33, the sheet separator 8, the thermal fixing unit 6 and an upper discharge (drive) roller **36*a* of the discharge roller pair 36. The upper cover 11 is opened upward of the apparatus (upward in the diagram) around a rotary shaft (not shown). A lower discharge (pinch) roller 36*b* of the discharge roller pair 36 is provided on the upper cover 11**.

Figure 6A:
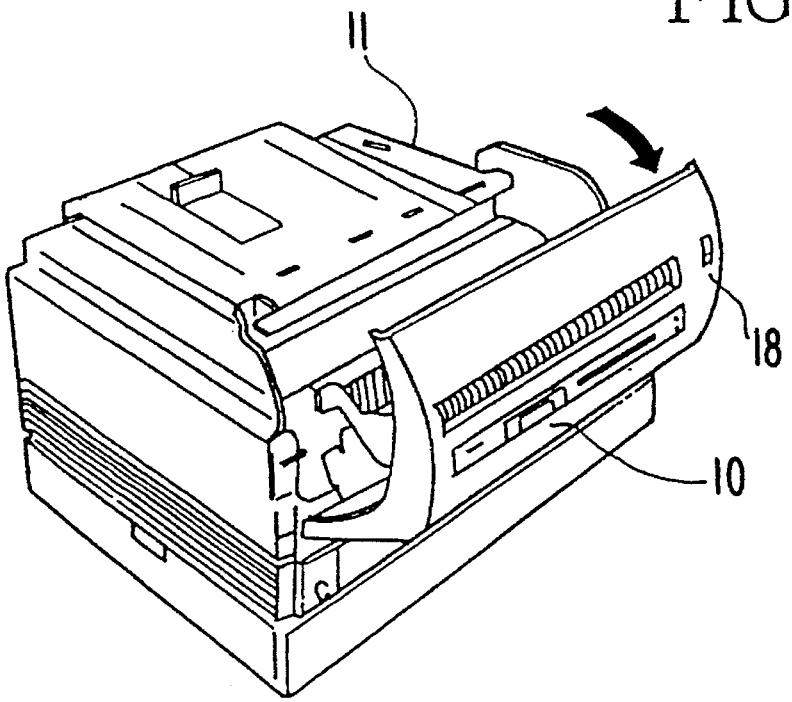
FIGS. 6A and 6B are diagrams illustrating the image forming apparatus of FIG. 2 with the covers open.

When the front cover 10 is opened by unlocking a lock lever 18 of the front cover 10, as shown in FIGS. 5 and 6A, the U-shaped feeding path 3 extending from the resist roller 31 to the discharge rollers 36 is opened, making it easier to remove any jammed sheets. If the transfer roller 42 is shifted from the proper position facing the photosensitive drum 40, i.e., if there is a shift in parallelism and position to the photosensitive drum 40, image transfer cannot be executed properly. In this respect, the transfer roller 42 is provided on the process cartridge 2. Although this design does not open the space between the photosensitive drum 40 and the transfer roller 42, a jammed sheet can easily be removed without any problem even if that portion does not become free.

The reason why the thermal fixing unit 6 is provided on the front cover 10 is that if the thermal fixing unit 6 were divided to open the feeding path, a part of the thermal fixing unit should be provided on the process cartridge 2, thus inconveniencing a user to remove the process cartridge 2. Although this design does not open the space between the heat roller 60 of the thermal fixing unit 6 and the backup roller 61, a jammed sheet can easily be removed without any problem even if that portion does not become free.

Figure 6B:
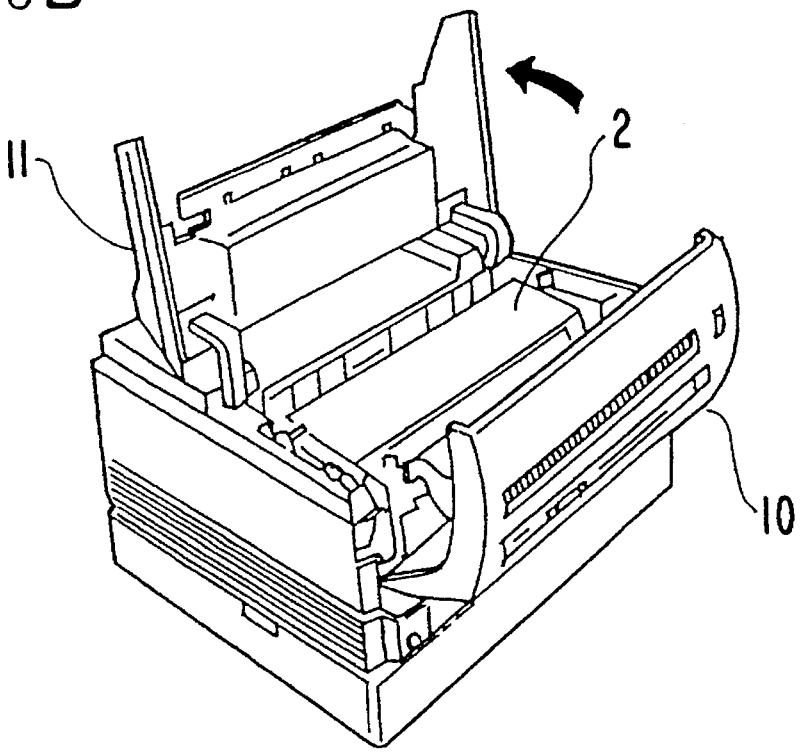

The front cover 10 is provided above the upper cover 11 at the sheet discharging portion so that the upper cover 11 does not become free unless the front cover 10 is opened as shown in FIG. 2. When the front cover 10 is opened and the upper cover 11 is opened next as shown in FIG. 6B, the top portion of the apparatus and part of the front portion of the apparatus are opened as shown in FIG. 5. Accordingly, the toner cassette 56 can easily be removed or attached from the front side of the apparatus while keeping the process cartridge 2 installed in the apparatus, thus allowing for the exchange of the toner cassette 56 alone.

Figure 7:
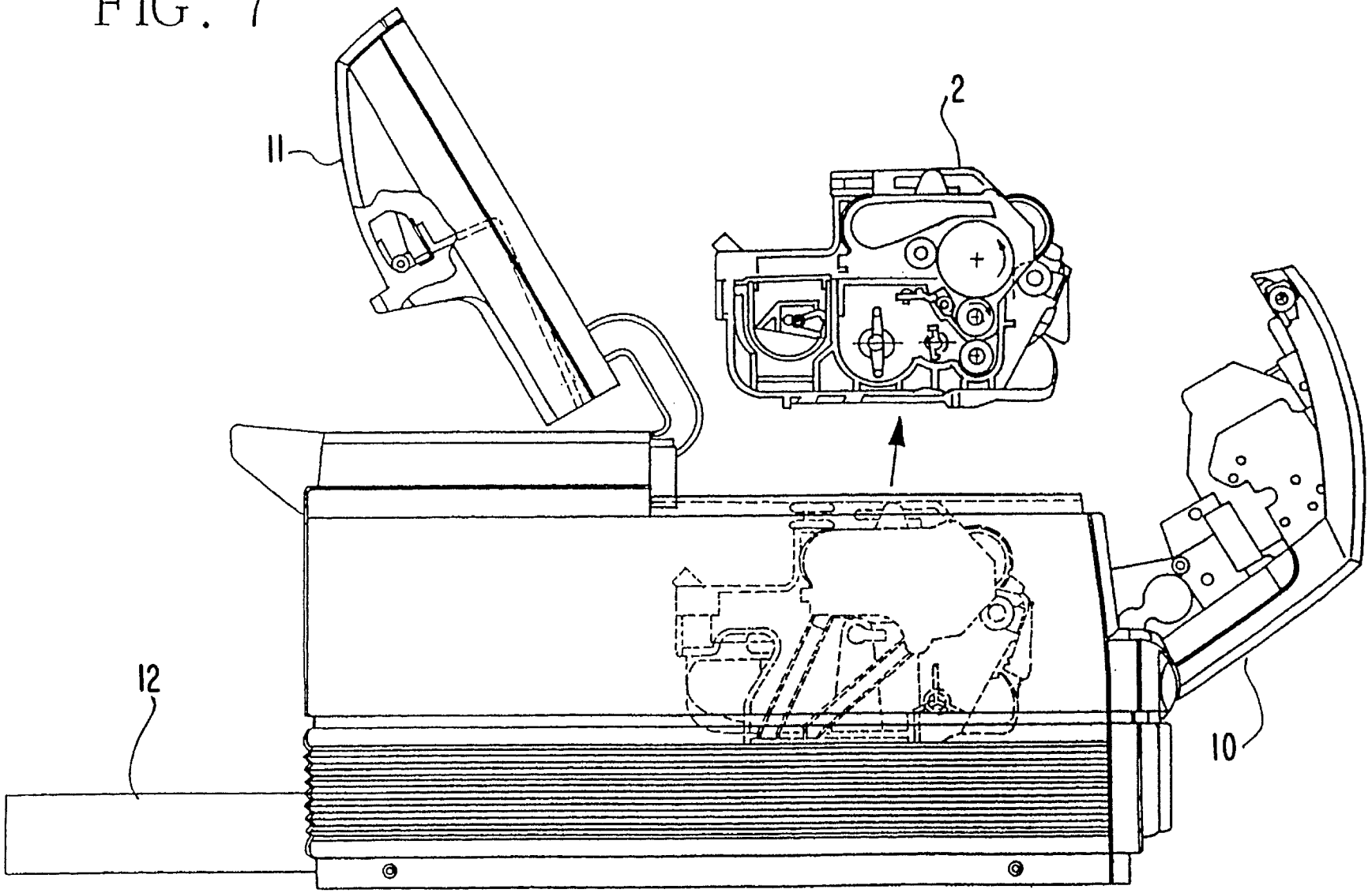
FIG. 7 is a diagram explaining how to exchange the process cartridge of the image forming apparatus shown in FIG. 3.

As the front side of the apparatus is opened by opening the front cover 10 and the top portion of the apparatus is opened by opening the upper cover 11 as shown in FIG. 7, the attachment and detachment of the process cartridge 2 can also be performed easily. Even if the process cartridge 2 is large, the exchange of the process cartridge 2 is therefore easy. In other words, the process cartridge 2 can be designed large, particularly, the developing unit 5 in the process cartridge 2 can be designed large, so that the quantity of the retainable developer can be increased, thus making the exchanging cycle of the developing unit 5 significantly long.

Further, since the developer can be supplemented through the exchange of the toner cassette 56 alone, the exchanging cycle of the developing unit 5 can be made longer. Furthermore, as the covers 10 and 11 are opened with the discharge rollers 36 separated into upper and lower rollers, the entire U-shaped feeding path 3 can be opened, thus facilitating removal of a jammed sheet.

Figure 8:
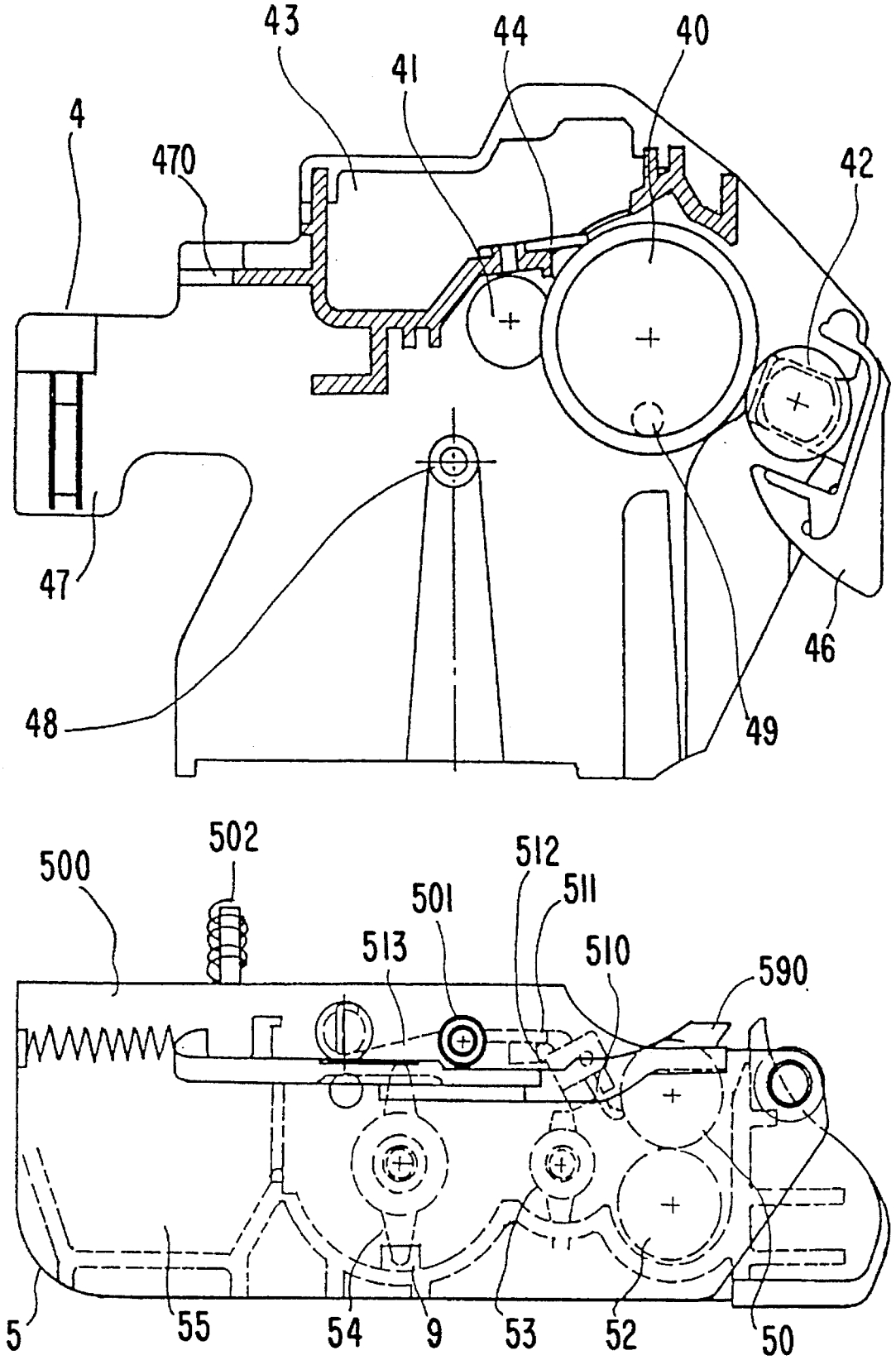
FIG. 8 is a cross section of a disassembled process cartridge shown in FIG. 4.
Figure 9:
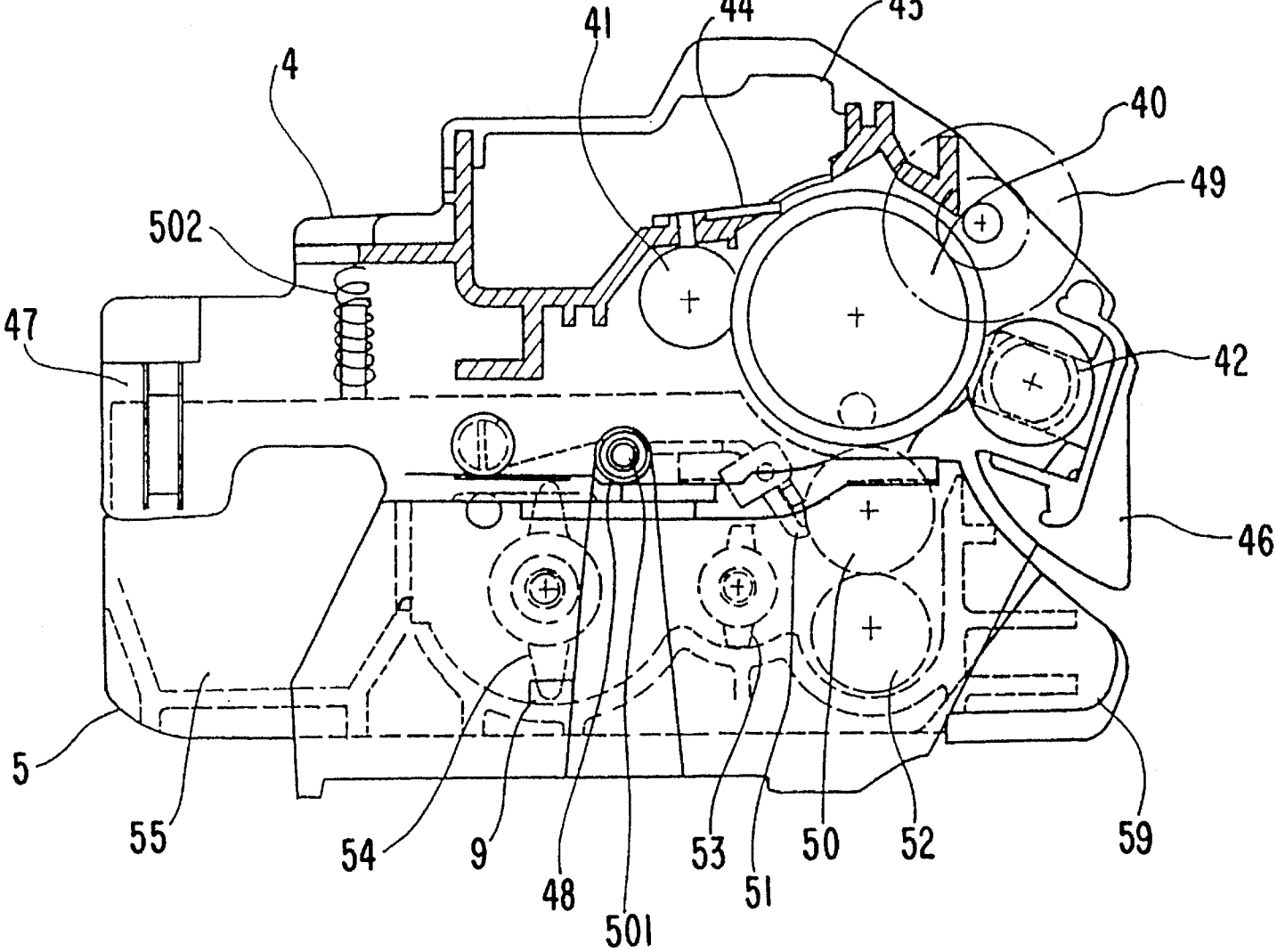
FIG. 9 is a cross section of the process cartridge in FIG. 8 assembled.
Figure 10:
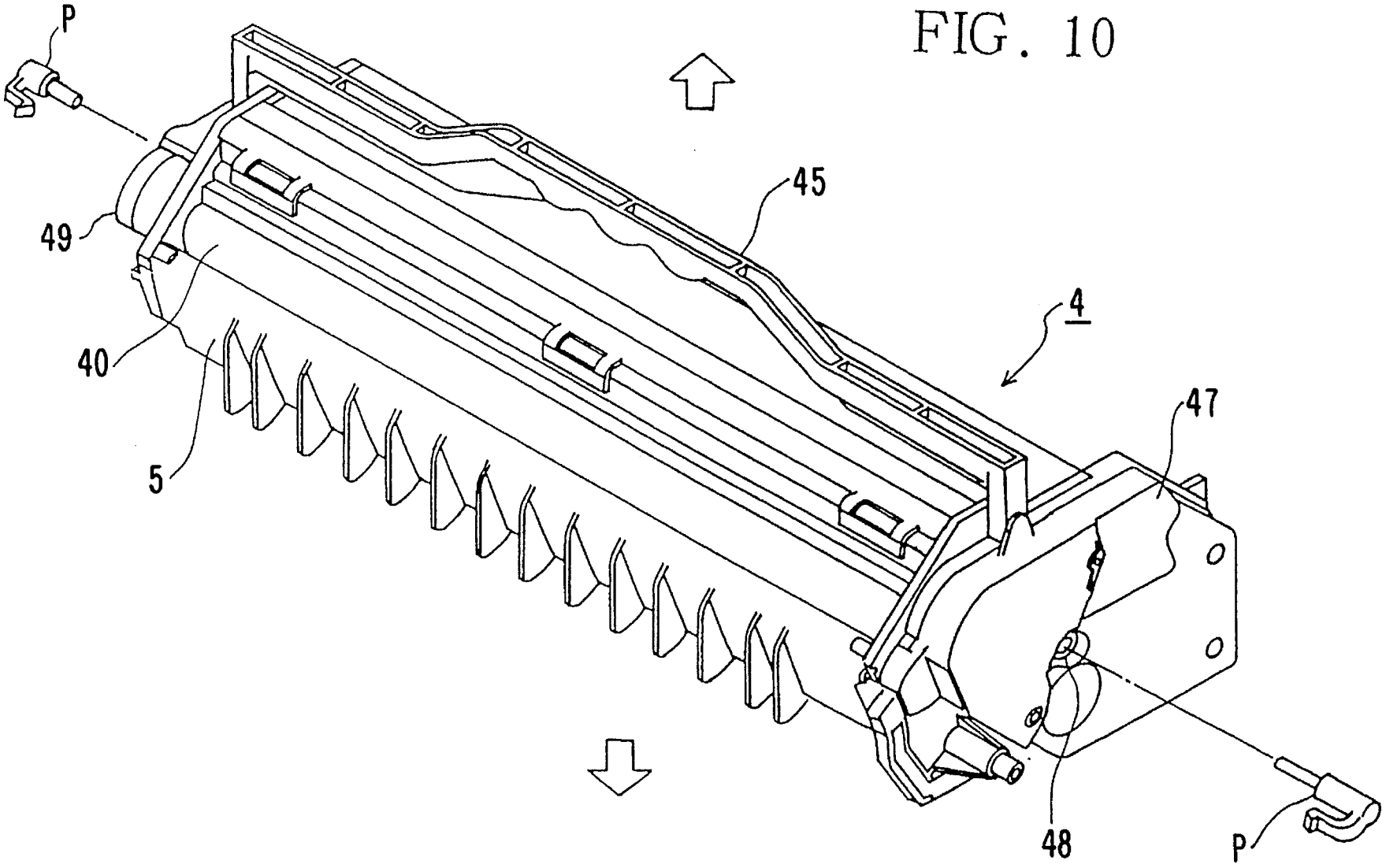
FIG. 10 is a perspective view of the assembled process cartridge in FIG. 9.

A description will now be given of the detachable structures of the process cartridge and the developing unit. FIG. 8 is a side view of the process cartridge in FIG. 4 disassembled, FIG. 9 is a diagram showing the process cartridge in FIG. 8 assembled, and FIG. 10 is a perspective view for explaining the assembling mechanism of the process cartridge in FIG. 8.

As shown in FIG. 8, the drum cartridge 4 has a unit frame 47. Provided in the unit frame 47 are the photosensitive drum 40, the charging roller 41, the transfer roller 42, the waste toner box 43, the roller cover 46, an engage pin 49 for attachment and detachment of the developing unit 5, and a presser portion 470 where the pressure spring of the developing unit 5 abuts. The lower portion of the unit frame 47 constitutes a retainer for the developing unit 5. Further, formed in the center of the unit frame 47 are pivot holes 48 where engage pins P shown in FIG. 10 are inserted.

The developing unit 5 has a developer frame 500 that constitutes side plates of the developing unit 5. Formed at both sides of and in the center of the developer frame 500 are free fits 501 where the engage pins P are to be freely fitted. A pressure spring (coil spring) 502 is provided on the left-hand side of each free fit 501 of the developer frame 500. The developing unit 5 is provided with a movable retraction lever 590 which will be described in detail later referring to the drawings following FIG. 11.

The developing unit 5 is inserted into the drum cartridge 4 from the bottom side thereof and the free fits 501 of the developing unit 5 are aligned with the pivot holes 48 of the drum cartridge 4. Then, the engage pins P are inserted into the pivot holes 48 of the drum cartridge 4 from both sides as shown in FIG. 10. As a result, the engage pins P, put through the pivot holes 48, are freely fitted in the free fits 501 of the developing unit 5. The engage pins P are engaged with the unit frame 47 to provide an integral structure.

Consequently, the developing unit 5 is housed and mounted in the drum cartridge 4 to become an integral unit as shown in FIG. 9. At this time, the developing unit 5 is rotatable around the engage pins P because of the engagement of the pins P with the free fits 501. The pressure spring 502 of the developing unit 5 abuts the presser portion 470 of the drum cartridge 4. Accordingly, counterclockwise rotational moment around the pivot point is given in FIG. 9 so that the developing roller 50 can be pressed against the photosensitive drum 40.

The developing roller 50 is therefore aligned with the photosensitive drum 40 by aligning the free fits 501 of the developing unit 5 with the pivot holes 48 of the drum cartridge 4, thus eliminating the need for a special positioning mechanism.

To detach the developing unit 5 from the drum cartridge 4, the engage pins P are disengaged and pulled out from the pivot holes 48 of the unit frame 47 of the drum cartridge 4, as shown in FIG. 10. Consequently, the developing unit 5 is separated from the drum cartridge 4 as indicated by the arrow in FIG. 10.

As the drum cartridge 4 and the developing unit 5 are assembled together or detached from each other, a user can detach or attach them from or to the apparatus by holding the handle 45 of the drum cartridge 4 to which the developing unit 5 is attached.

To exchange only the developing unit 5, the user should pull the drum cartridge 4 out of the apparatus and pull out the engage pins P so that the developing unit 5 can be separated from the drum cartridge 4. Then, the user should attach a new developing unit 5 to the drum cartridge 4 by inserting the engage pins P into the drum cartridge 4 and sets the assembled drum cartridge 4 into the apparatus.

To exchange only the drum cartridge 4, the user should likewise pull the drum cartridge 4 out of the apparatus and pull out the engage pins P to separate the developing unit 5 from the drum cartridge 4. Then, the user should attach the developing unit 5 to a new drum cartridge 4 by inserting the engage pins P into the drum cartridge 4 and sets the assembled drum cartridge 4 into the apparatus.

To exchange both the drum cartridge 4 and developing unit 5, the user has only to detach the drum cartridge 4 with the developing unit 5 from the apparatus and to set the assembly of a new developing unit 5 and a new drum cartridge 4 in the apparatus.

In any case, the attachment/detachment to or from the apparatus is accomplished in a single manipulation for each drum cartridge 4, thus facilitating the exchanging work. Even if the developing unit 5 is separated from the drum cartridge 4 and is then attached thereto, it is unnecessary to align the developing unit 5 with the photosensitive drum 40.

Figure 11:
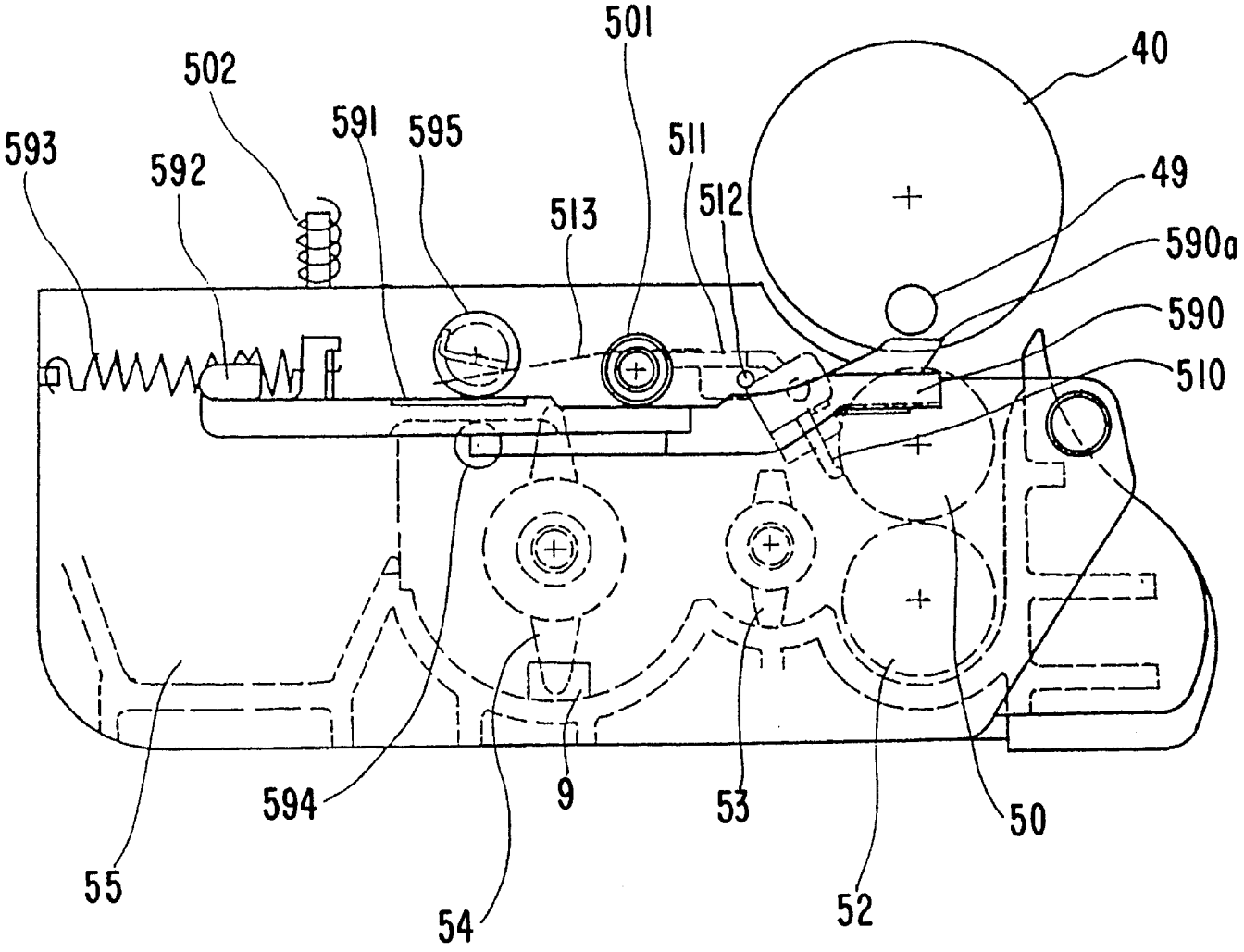
FIG. 11 is a cross section of an abutting/detaching mechanism of the developing unit.

The abutting/detaching mechanism will now be described. FIG. 11 is a cross-sectional view for explaining the abutting/detaching mechanism in FIG. 8, FIG. 12 is a top view of the abutting/detaching mechanism and FIG. 13 shows the structure of the abutting/detaching mechanism.

Figure 12:
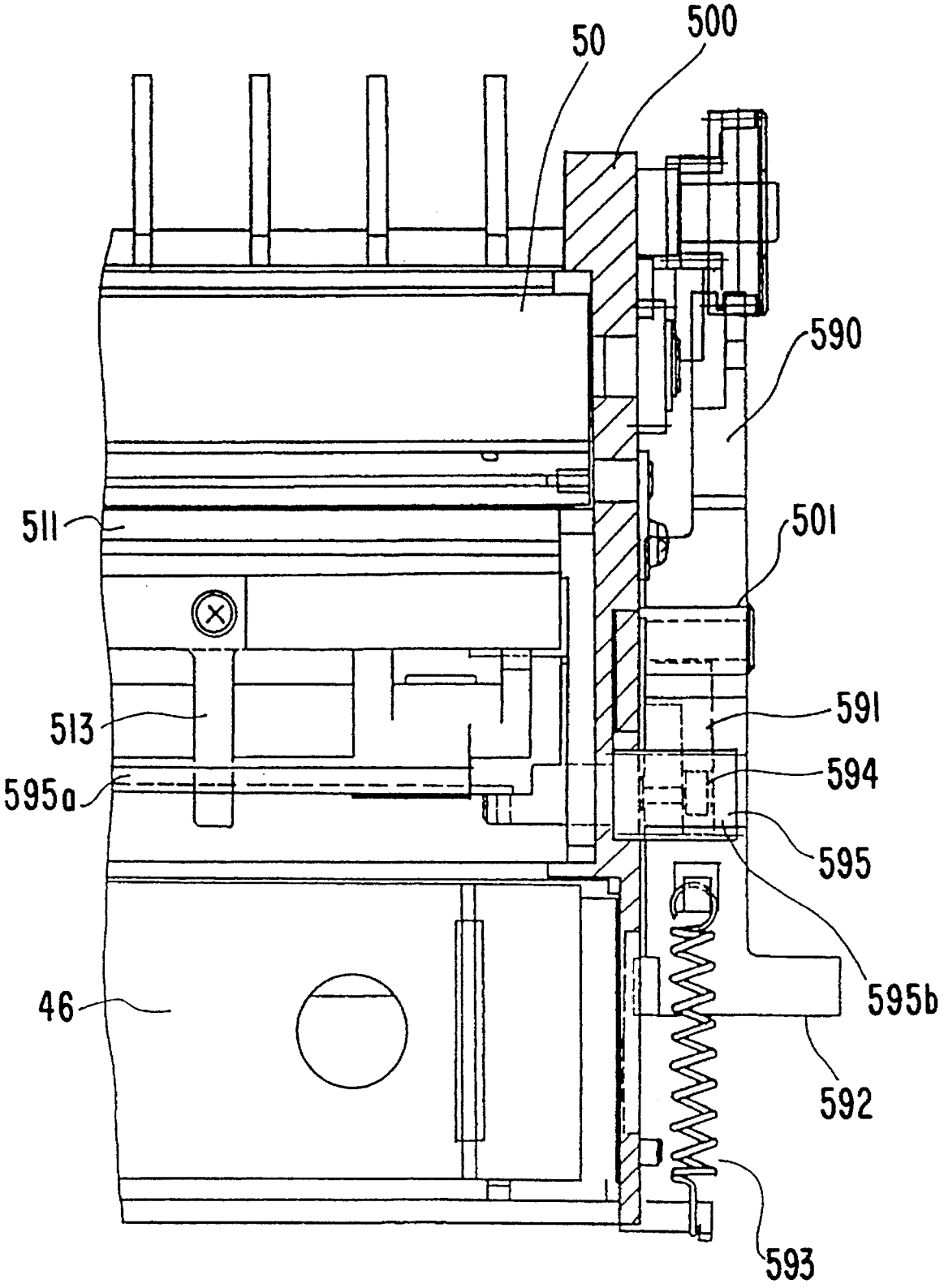
FIG. 12 is a top view of the abutting/detaching mechanism of the developing unit.
Figure 13:
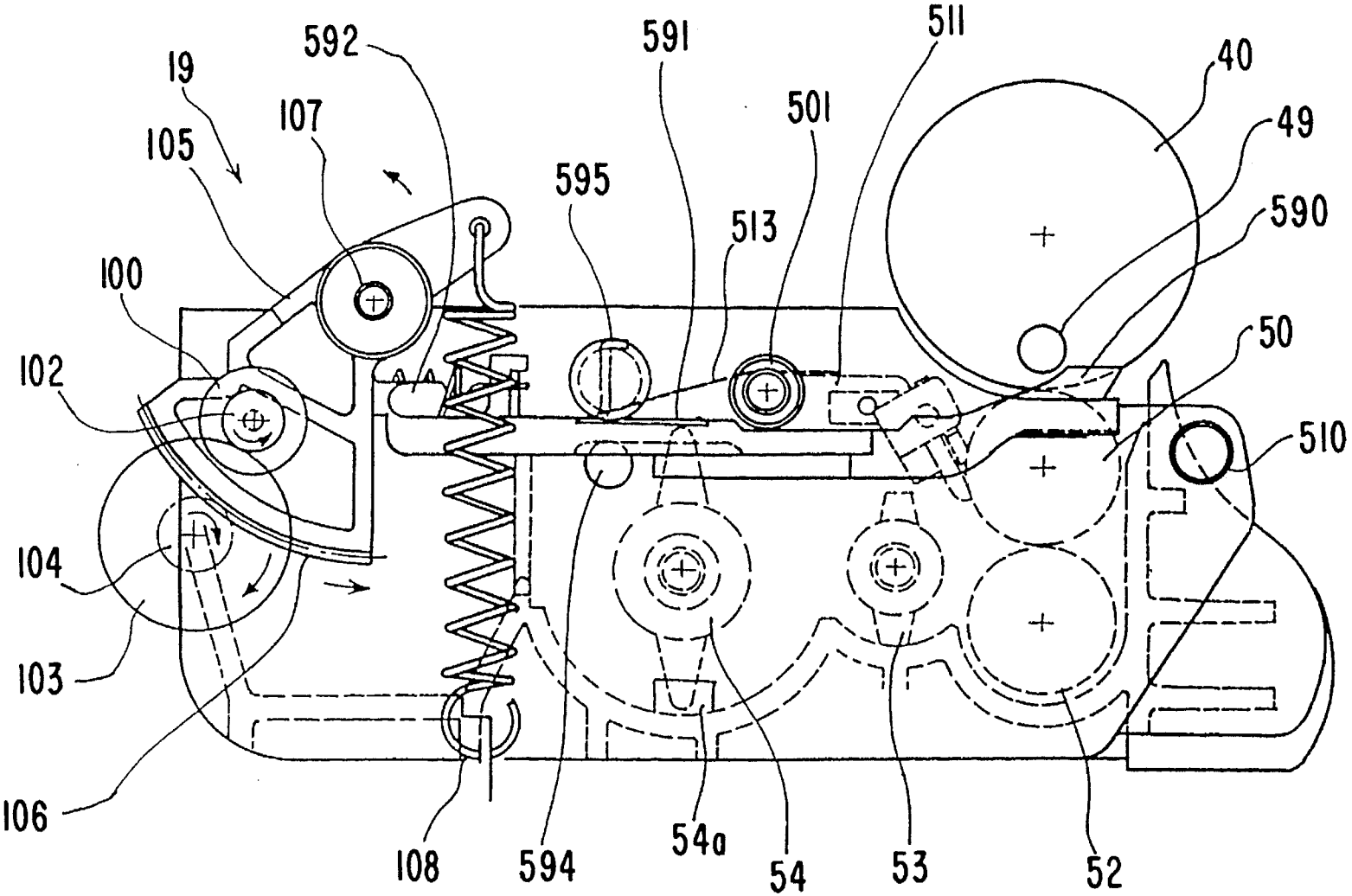
FIG. 13 is a diagram for explaining the function of the abutting/detaching mechanism of the developing unit.

Referring to FIGS. 11 and 12, the blade 51 of the developing unit 5 has a blade body 510 supported on an L-shaped blade holder 511. The blade holder 511 is rotatable around a rotary shaft 512. Further, one end of the blade holder 511 is pressed by a leaf spring 513 so that the blade body 510 is pressed against the developing roller 50.

As shown in FIGS. 11 and 12, the retraction lever 590 is provided on the side of the developer frame 500 to be movable in the right and left direction in FIG. 11. This retraction lever 590 has a projection **590*a* formed at the distal end, which engages with the engage pin 49 provided on the frame 47 of the drum cartridge 4. FIG. 11 illustrates the state in which this engagement is made; as the retraction lever 590 is moved leftward in the diagram to establish the engagement of the projection 590*a* with the engage pin 49, so that the developing unit 5 rotates clockwise in the diagram, separating the developing roller 50 from the photosensitive drum 40**.

A reset spring 593 is provided at the rear end of the retraction lever 590, and is connected to the frame 500 of the developing unit 5. Normally, the projection **590*a* of the retraction lever 590 is engaged with the engage pin 49 provided on the frame 47 of the drum cartridge 4 by the reset spring 593 and is at a retract position to set the developing roller 50 away from the photosensitive drum 40** as illustrated.

A flat gear 591 is formed in the center portion of the retraction lever 590 and is engaged with a gear **595*b* of a blade retraction member 595. A presser portion 592 that is pressed by a drive mechanism 19, which will be described later referring to FIG. 13, is provided at the rear portion of the retraction lever 590. This retraction lever 590 is supported, at the center, between the gear 595*b* of the blade retraction member 595 and a guide roller 594 provided on the side of the developer frame 500**.

As shown in FIG. 12, the blade retraction member 595 has a lever **595*a* coupled to the gear 595*b* which is to be engaged with the flat gear 591. This lever 595*a* is engaged with the leaf spring 513 of the blade 51. In the retraction state shown in FIG. 11, the lever 595*a* is positioned horizontally to relax the pressure of the leaf spring 513, thus reducing the pressure of the leaf spring 513 on the developing roller 50 of the blade body 510**.

In FIG. 13, the drive mechanism 19 is provided on the apparatus side. This drive mechanism 19 has an abutting/detaching motor 100, a motor gear 102 provided on the shaft of the motor 100, a drive gear 103 which engages with the motor gear 102, a gear 104 provided coaxial with the drive gear 103, a drive lever 105 rotatable around the rotary shaft 107, a gear tooth 106 with the shape of a half-moon which engages with the gear 104, and a reset spring 108 for urging the drive lever 105 clockwise around the rotary shaft 107.

The function of this abutting/detaching mechanism will now be described. In the retraction state in FIG. 11, when the motor 100 rotates counterclockwise as indicated in FIG. 13, the gear 104 rotates clockwise through the gears 102 and 103. The gear 104 engages with the gear tooth 106 of the drive lever 105, causing the drive lever 105 to rotate counterclockwise around the rotary shaft 107 against the force of the reset spring 108.

The rotation of the drive lever 105 pushes the presser portion 592 at the rear end of the retraction lever 590, moving the lever 590 rightward in FIG. 13. This releases the engagement of the projection **590*a*** of the retraction lever 590 with the engage pin 49 of the drum cartridge 4. As a result, the developing roller 50 of the developing unit 5 is pressed against the photosensitive drum 40 to come in contact therewith by the rotational moment of the pressure spring 502 (see FIG. 11) around the free fits 501.

In addition, as the flat gear 591 of the retraction lever 590 moves, the gear 595*b* of the blade retraction member 595 rotates clockwise. As shown in FIG. 13, the lever 595*a* coupled to the gear 595*b* is positioned vertically, pressing the leaf spring 513. Consequently, the pressure of the blade body 510 on the developing roller 50 is increased, enabling the restriction of the toner thickness.

To return to the retraction state, on the other hand, the motor 100 is rotated clockwise to rotate the gear 104 counterclockwise via the gears 102 and 103, and the drive lever 105 is rotated clockwise around the rotary shaft 107 by the engagement of the gear 104 with the gear tooth 106 of the drive lever 105. The rotation of the drive lever 105 releases the pressure off the presser portion 592 at the rear end of the retraction lever 590, and the retraction lever 590 moves leftward in FIG. 13 by the reset spring 593. As a result, the projection 590*a* of the retraction lever 590 comes to the engagement with the engage pin 49 of the drum cartridge 4.

This causes the developing unit 5 to rotate counterclockwise around the free fits 501 so that the developing roller 50 is moved away from the photosensitive drum 40 to come to the retraction state. At the same time, the flat gear 591 of the retraction lever 590 moves to rotate the gear 595*b* of the blade retraction member 595. As a result, the lever 595*a* is positioned horizontally to release the pressure of the leaf spring 513 as shown in FIG. 11, thus reducing the pressure of the blade body 510 on the developing roller 50 to permit fast rotation of the developing roller 50.

In this abutting/detaching mechanism, the pressure of the blade body 510 is released at the same time as the developing roller 50 is retracted, the thermoplastic deformation of the developing roller 50 is prevented and the fast rotation of the developing roller 50 at the retraction position is allowed. When the power is set off and the rotational power of the motor 100 is gone in the contact state, the drive lever 105 is forcibly rotated clockwise by the reset spring 108 to come to the retraction state.

Figure 14:
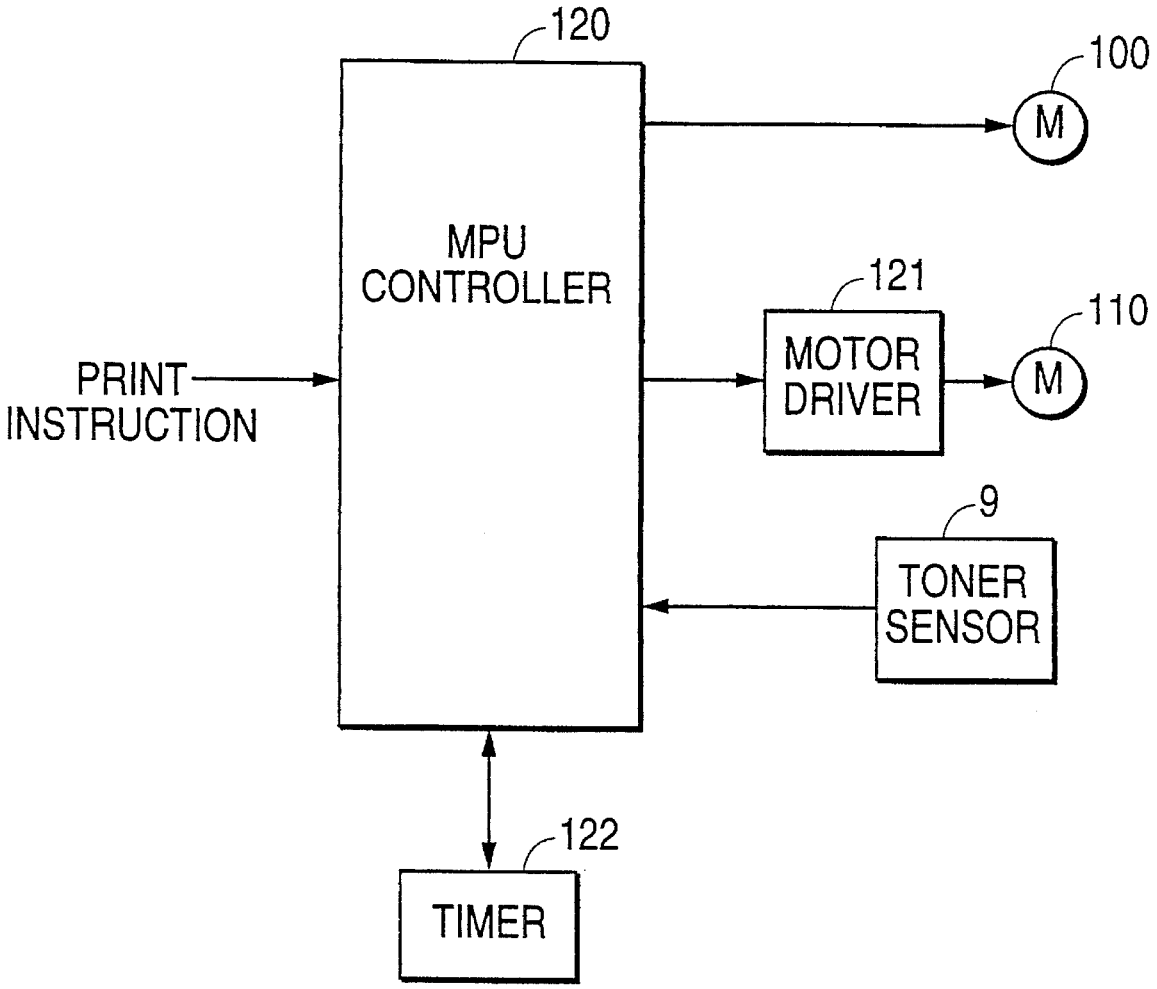
FIG. 14 is a block diagram of a control section according to one embodiment.

FIG. 14 is a control block diagram. In FIG. 14, reference numeral 120 denotes a controller constituted of a microprocessor. The controller 120 drives a drum motor (not shown) which rotates the photosensitive drum 40, etc. upon reception of a print instruction, controls the driving of the abutting/detaching motor 100 and developing motor 110 upon reception of the output of the toner sensor 9. The developing motor 110 drives the developing unit 5 in such a way that the developing roller 50, reset roller 52, paddle rollers 53 and 54 and the supply lever 57 of the toner cassette 56 in the developing unit 5 are rotated synchronously by the gear train (not shown). A motor driver 121 drives the developing motor 110 in response to an instruction from the controller 120. A timer 122 provides time information for the controller 120.

Figure 15:
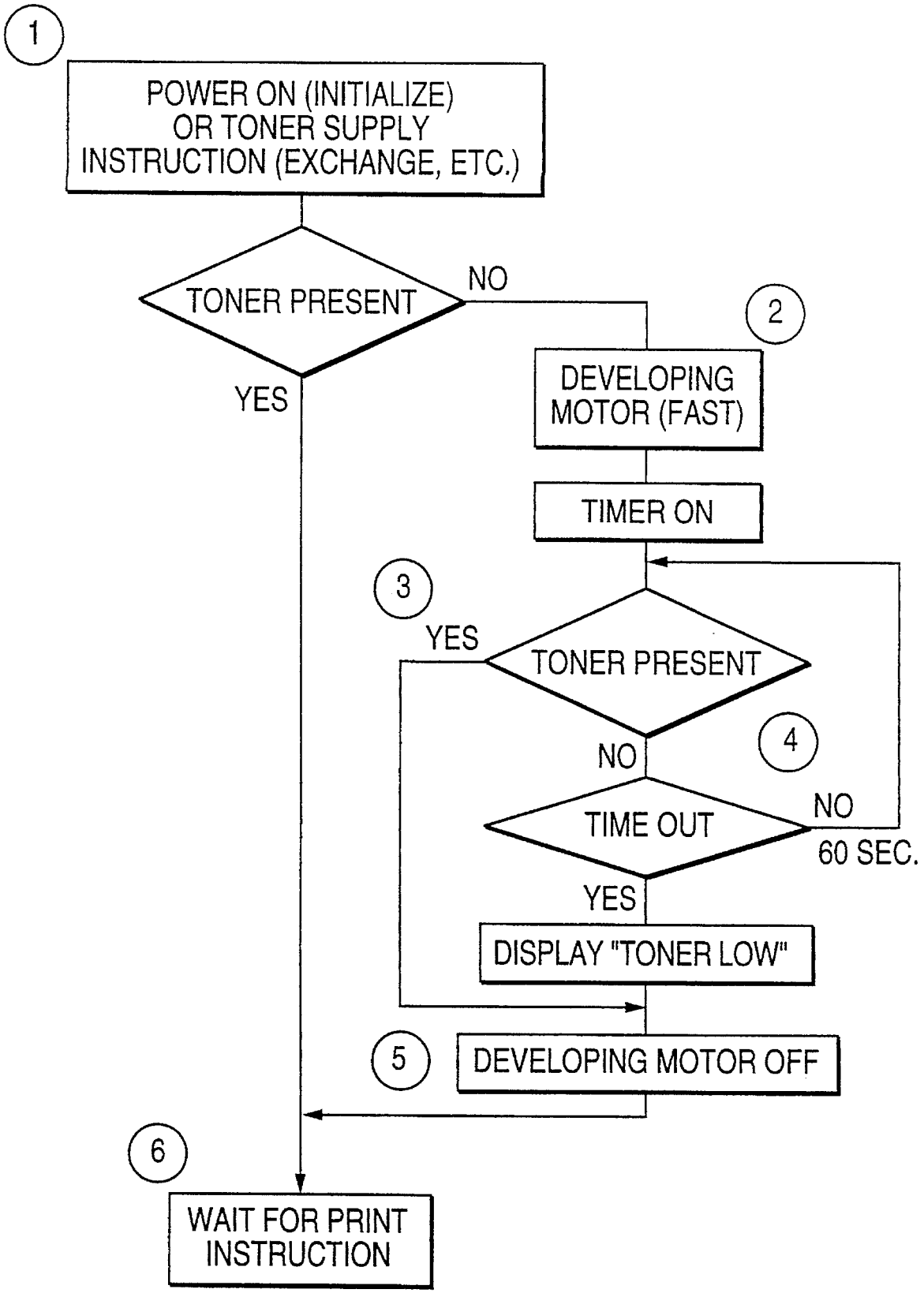
FIG. 15 is a flowchart showing a process in developer supply mode.
Figure 16:
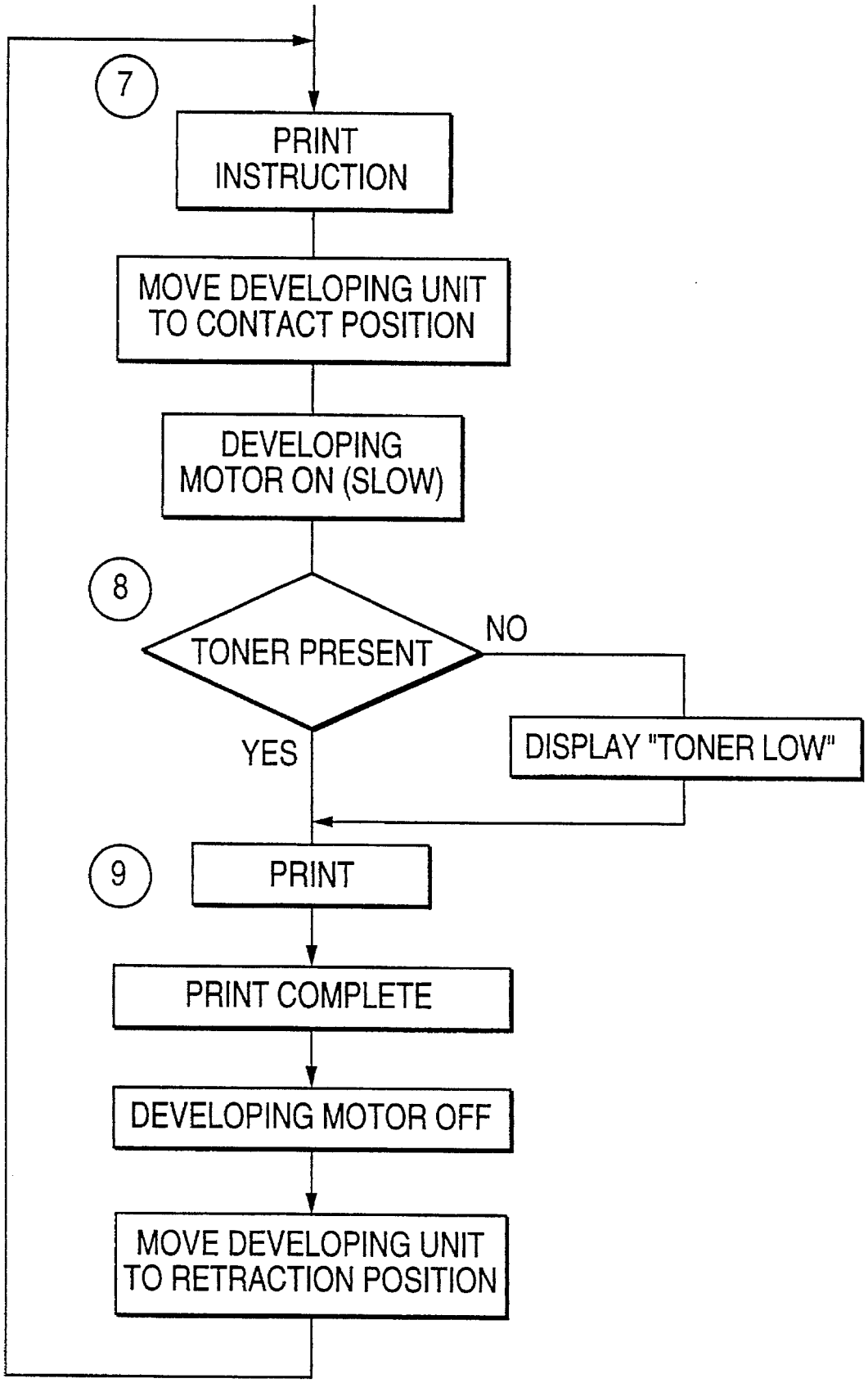
FIG. 16 is a flowchart showing a process in print mode.

FIG. 15 is a flowchart of a process of supplying a developer, and FIG. 16 is a flowchart of a printing process.

The developer supplying process before printing will be described referring to FIG. 15.

(1) At the time of initialization when power is given or when the toner cassette 56 is exchanged with a new one and a toner supply instruction is given from the operation panel (see FIG. 2) 16, the controller (hereinafter called "processor") 120 reads the output of the toner sensor 9 of the developing unit 5 and determines if the toner is at the position of the paddle roller 54 in the developing unit 5. When determining that the toner is present, the processor 120 goes to step (6) to be read for a print instruction.

(2) When determining that the toner is gone, the processor 120 issues a fast-speed instruction to the motor driver 121 to rotate the developing motor 110 at a high speed (e.g., 1.2 times the normal speed) and activates the timer 122. At this time, the developing unit 5 is at the retraction position as will be described with reference to FIG. 16. Accordingly, the developing roller 50, reset roller 52, paddle rollers 53 and 54 and supply lever 57 rotate at a high speed. If there is a toner in the toner cassette 56, this toner is charged quickly and is supplied to the developing roller 50.

(3) The processor 120 reads the output of the toner sensor 9 of the developing unit 5 to determine if the toner is at the position of the paddle roller 54 in the developing unit 5. When judging that the toner is at the position of the paddle roller 54 in the developing unit 5, the processor 120 determines that part of the toner that has reached the developing roller 50 and the toner on the developing roller 50 that has become uniform, and then moves to step (5).

(4) If the processor 120 determines that the toner is not at the position of the paddle roller 54 in the developing unit 5, the processor 120 determines if there is a timeout (timeout of 60 sec) of the timer 122. If there is no timeout, the processor 120 returns to step (3). If there is a timeout, however, the processor 120 considers that the toner is not found in the toner cassette 56 because the toner has not been supplemented even after the developing unit 5 for 60 sec. Then, the processor 120 displays a toner low (toner shortage) on the operation panel 16 before advancing to step (5).

(5) The processor 120 instructs a motor deactivation to the motor driver 121 to stop the developing motor 110 and then goes to step (6).

(6) The processor 120 waits for a print instruction from a higher-level unit. The print instructing process will now be described referring to FIG. 16.

(7) Upon reception of the print instruction from a higher-level unit, the processor 120 rotates the abutting/detaching motor 100 to drive the retraction lever 590 so that the developing unit 5 moves to the contact position as indicated in FIGS. 11 through 13. The developing roller 50 contacts the photosensitive drum 40 and the pressure of the blade body 510 on the developing roller 50 is increased.

Then, the processor 120 drives the developing motor 110 at a constant velocity through the motor driver 121. At the same time, the processor 120 drives the drum motor for the photosensitive drum 40.

(8) The processor 120 reads the output of the toner sensor 9 of the developing unit 5 to determine if the toner is at the position of the paddle roller 54 in the developing unit 5. If the processor 120 determines that the toner is not at the position of the paddle roller 54 in the developing unit 5, the processor 120 displays a toner low (toner shortage) on the operation panel 16 and then moves to step (9). If the processor 120 determines that the toner is at the position of the paddle roller 54 in the developing unit 5, on the other hand, which does not mean insufficient toner, the processor 120 advances to step (9). In this toner short state, about a dozen sheets can be printed so that printing need not be stopped.

(9) The processor 120 performs a sequence of printing operations of driving the optical unit 7 to write an image on the photosensitive drum 40 in accordance with print data following the print instruction, performing development in the developing unit 5, transferring the image on a sheet with the transfer roller 42 and fixing the image with the thermal fixing unit 6. When printing is complete, the processor 120 causes the motor driver 121 to stop the developing motor 110 and likewise stops the drum motor. Further, the processor 120 drives the abutting/detaching motor 100 in the retraction direction to move the developing unit 5 to the retraction position, separating the developing roller 50 from the photosensitive drum 40, as shown in FIGS. 11 through 13, and decreases the pressure of the blade body 510 before returning to step (7).

As described above, when the toner cassette 56 is exchanged, the developing unit 5 is driven at a high speed to supply the toner in the toner cassette 56 to the developing roller 50 to set the toner of the roller 50 evenly to be ready for a print instruction, thus ensuring stable development from the initial stage. Similarly, the developing unit 5 is driven at a high speed to supply the toner to the developing roller 50 before printing, so that a sufficient amount of a toner for development can be supplied to the developing roller 50 even when the amount of the toner becomes small.

Because of the fast driving of the developing unit 5, even if the developing unit 5 is enlarged to make the toner path longer in order to increase the retainable amount of the toner, the toner is supplied to the developing roller 50 from the cassette 56 and is charged quickly. It is therefore unnecessary to set the period until the point of waiting for the print instruction longer.

Further, when the toner reaches a predetermined position, the driving of the developing unit 5 is stopped to be ready for the print instruction, the period until the print-instruction waiting time need not be set long.

If toner present is not detected from the output of the toner sensor 9 within a predetermined period of time after the driving of the developing-unit driving unit starts, the driving of the developing unit 5 is stopped to be ready to accept an image forming instruction. When the toner cassette has not been exchanged, therefore, a wasteful toner supplying operation will not be resumed.

If toner present is not detected from the output of the toner sensor 9 within a predetermined period of time after the driving of the developing-unit driving unit starts, " toner shortage" is displayed and a toner exchange instruction will be given considering that the toner cassette has not been exchanged.

The shortage of the toner is detected from the output of the toner sensor 9 after the power is given or an instruction to exchange the toner cassette is received, and the toner supply will be executed at the point of time when it is expected that the exchange of the toner cassette had been carried out. In this manner, the inhibition of the reception of the image forming instruction is executed only when necessary.

Figure 17:
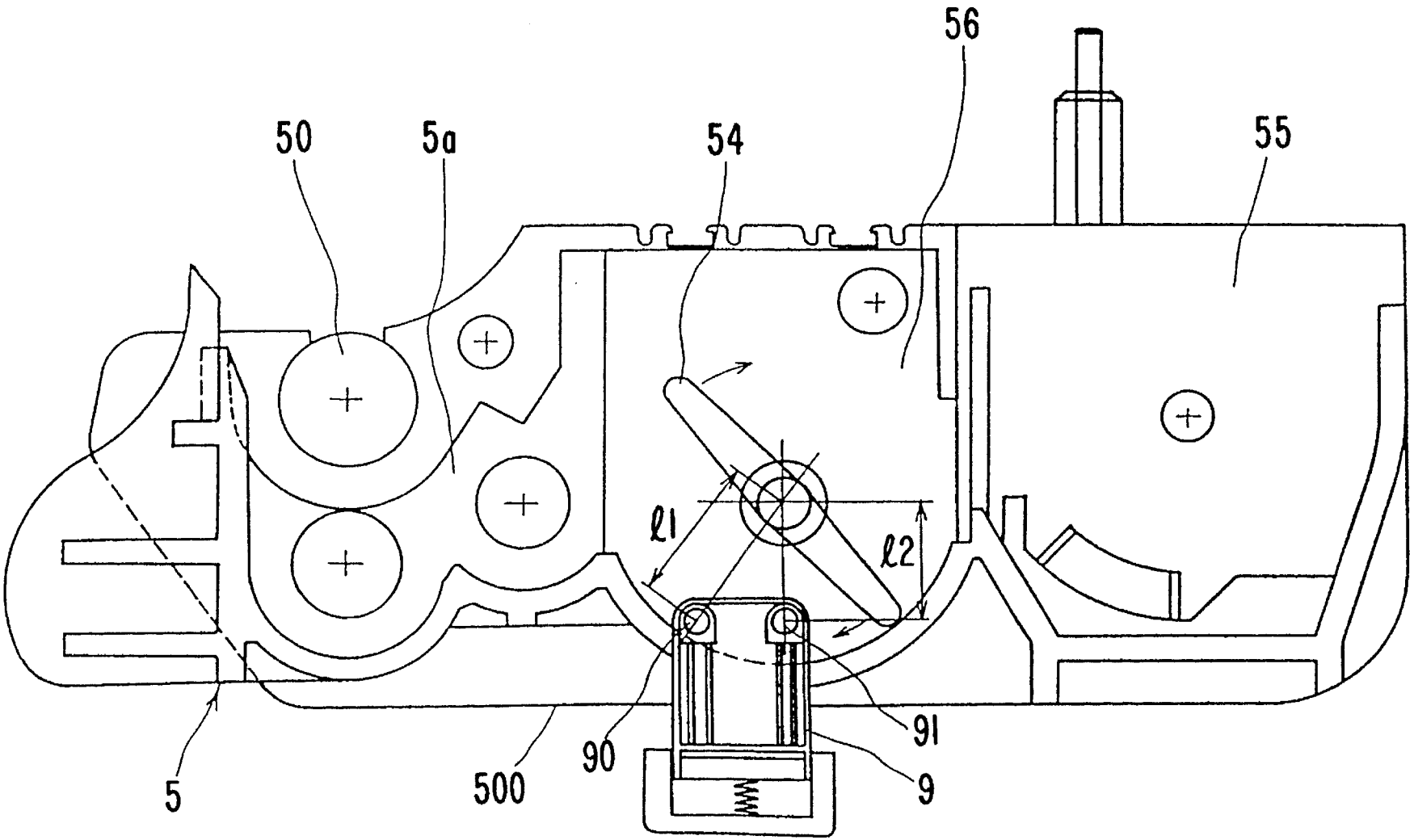
FIG. 17 is a front view of a toner sensor.
Figure 19:
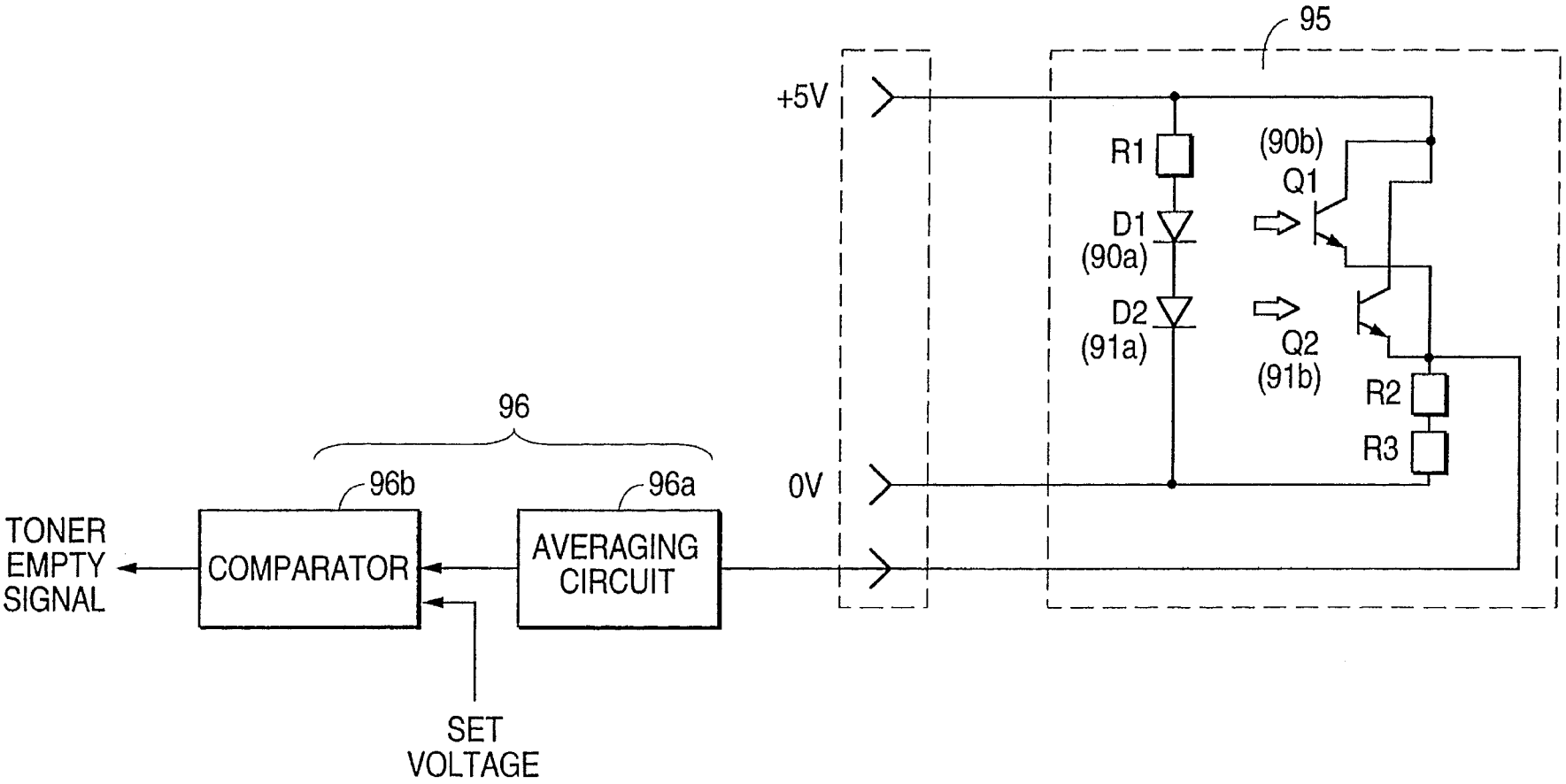
FIG. 19 is a circuit diagram of the toner sensor.
Figure 20A:
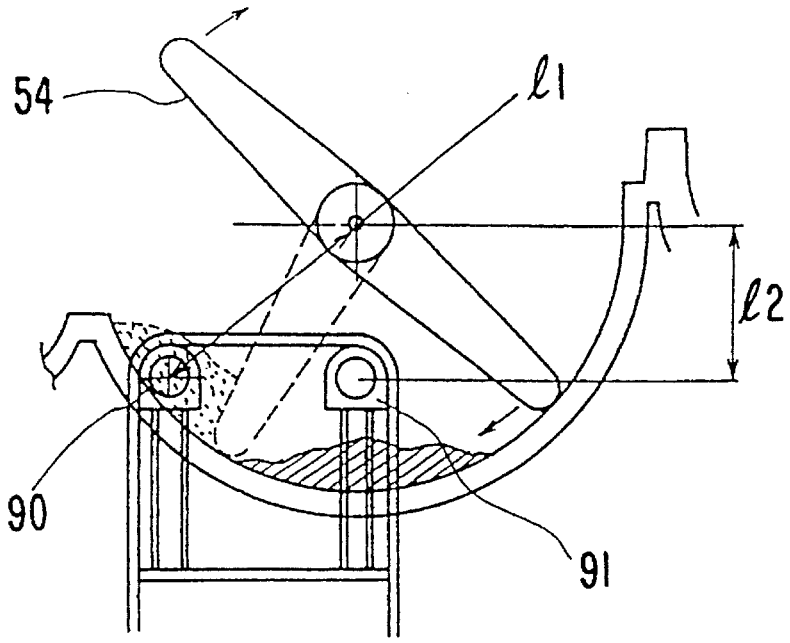
FIGS. 20A and 20B are diagrams for explaining the function of the toner sensor.
Figure 20B:
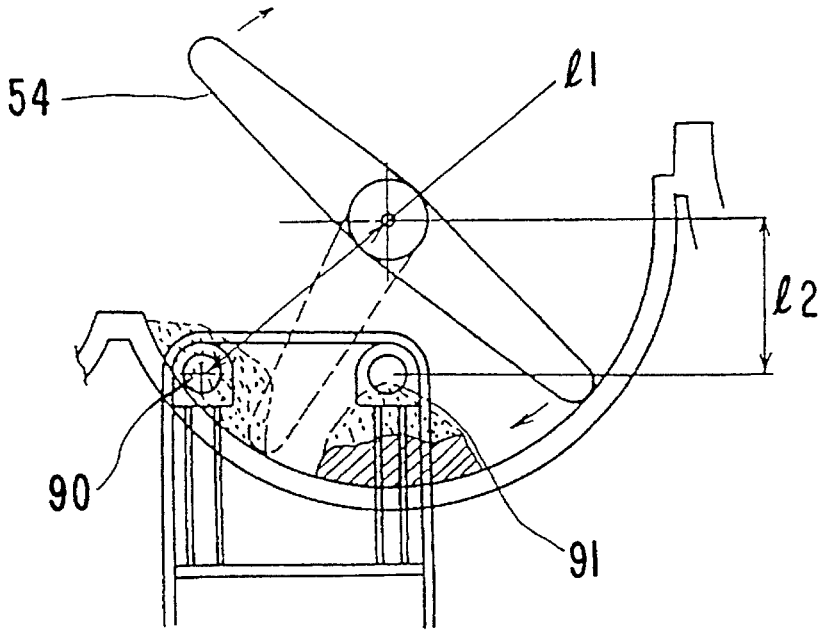
Figure 21:
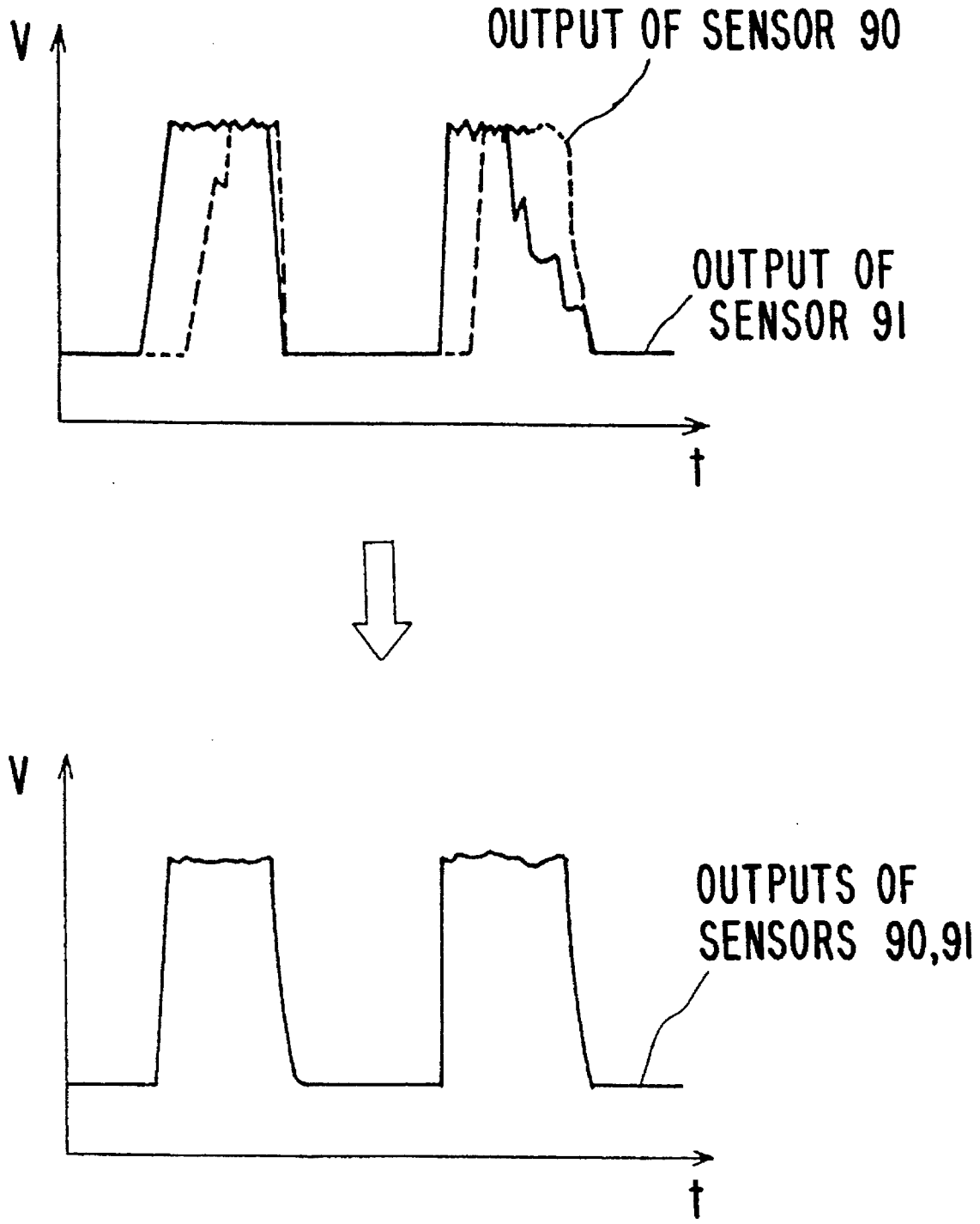
FIG. 21 is a diagram showing the output waveforms of the toner sensor.
Figure 22:
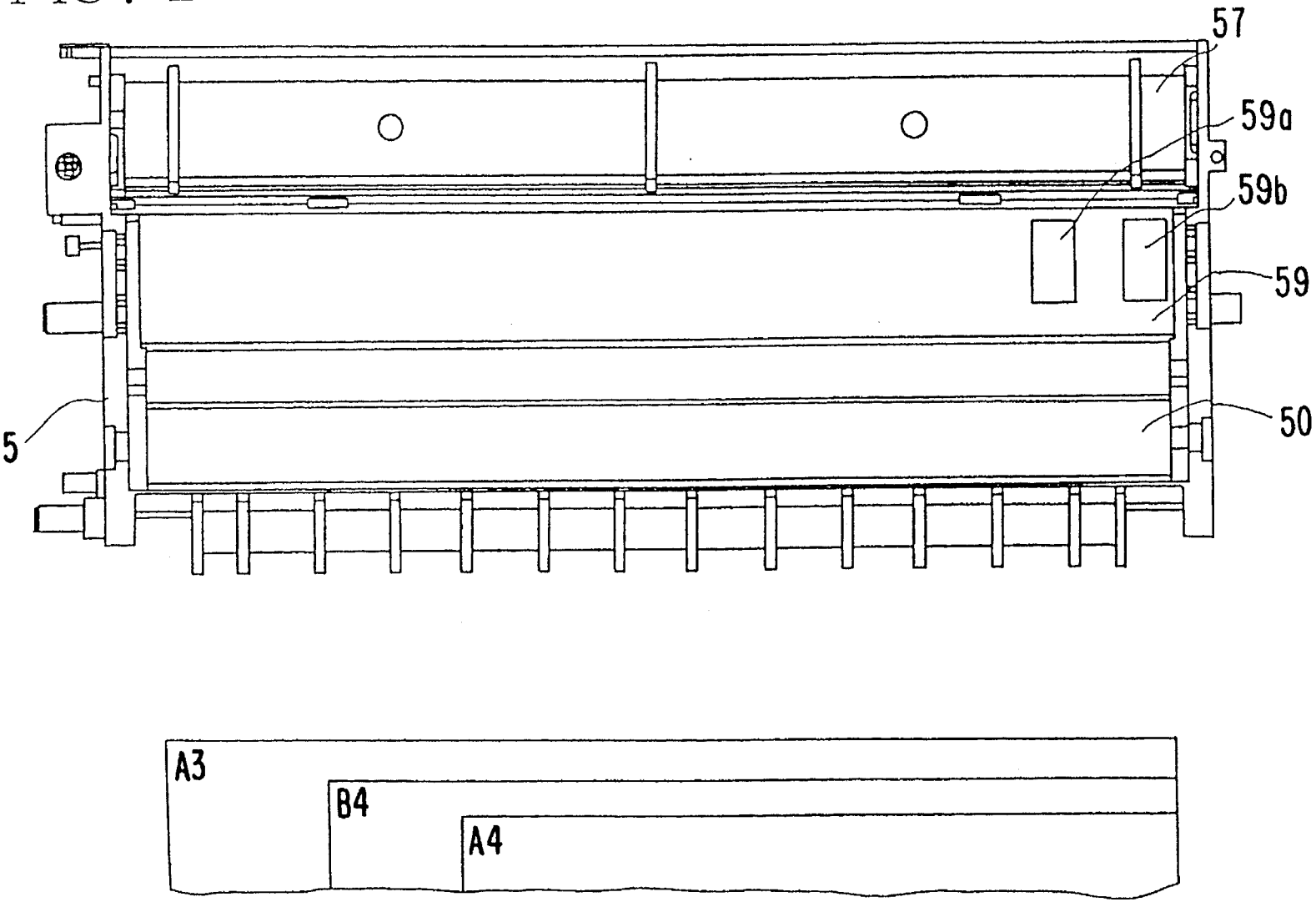
FIG. 22 is a diagram for explaining the arrangement of the toner sensor.

A description of toner sensor is provided below. FIG. 17 is a front view for explaining the toner sensor, FIG. 18 is a side view for explaining the toner sensor, FIG. 19 is a circuit diagram of the toner sensor, FIGS. 20A and 20B are diagrams for explaining the function of the toner sensor, FIG. 21 shows the waveforms of the toner sensor, and FIG. 22 is a diagram for explaining the arrangement of the toner sensor.

As shown in the side view of the developing unit 5 in FIG. 17, the toner sensor 9 is provided under the storage room 5*b* of the developing unit 5. This toner sensor 9 has two transmission photosensors 90 and 91. The first transmission photosensor 90 is located away from the shaft of the agitator 54 by a distance l1 in the direction of the diameter of the agitator 54, and the second transmission photosensor 91 is located away from the shaft of the agitator 54 by a distance l2 (l2<l1) in the direction of the diameter of the agitator 54.

Figure 18:
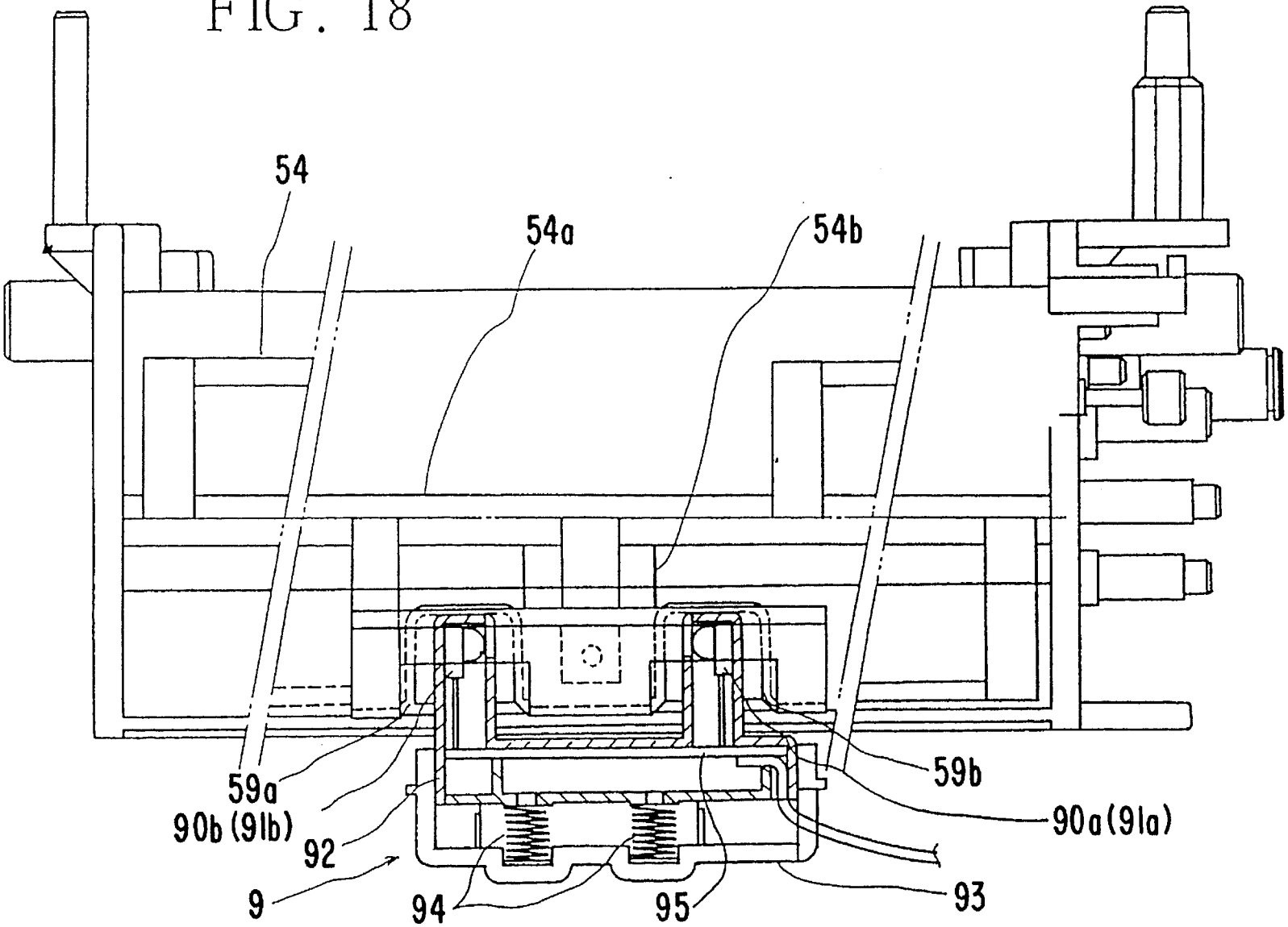
FIG. 18 is a side view of the toner sensor.

As shown in FIG. 18, the toner sensor 9 is provided on the apparatus side. The toner sensor 9 has a case 92 which is urged by springs 94 and has a cross section with the shape of "]." In this case 92, light-emitting portions 90*a* and 91*a* of the transmission photosensors 90 and 91 and light-receiving portions 90*b* and 91*b* are mounted on a sensor substrate 95. This case 92 prevents the light-emitting portions 90*a* and 91*a* and the light-receiving portions 90*b* and 91*b* from being stained by dust, scattered toner or the like.

A pair of transparent sensor retainers 59*a* and 59*b* are provided under the storage room 5*b* of the developing unit 5 in such a way as to protrude into the storage room 5*b*. The space between the sensor retainers 59*a* and 59*b* forms space where a wiper 54*b* provided on an agitator shaft 54*a* passes.

The light-emitting portions 90*a* and 91*a* and the light-receiving portions 90*b* and 91*b* of the case 92 are to be housed in the sensor retainers 59*a* and 59*b* of the storage room 5*b*. The abutting portion of the case 92 abuts on the bottom of the frame 500 of the developing unit 5 to be positioned by the spring 94. Even when the developing unit 5 is exchanged, therefore, the transmission photosensor pair 90 and 91 can be positioned at predetermined positions in the storage room 5*b* of the developing unit 5.

The light-emitting window and light-receiving window of the sensor retainers 59*a* and 59*b* are cleaned by the wiper 54*b* provided on the agitator shaft 54*a* in accordance with the rotation of the agitator 54 to remove the sticking toner, thus ensuring stable toner detection.

In FIG. 19, a resistor R1 and a pair of light-emitting portions (light-emitting diodes) D1 (90*a*) and D2 (91*a*) are connected in series between the terminal of +5 V and the terminal of 0 V on the sensor substrate 95. Further, a pair of light-receiving portions (phototransistors) Q1 (90*b*) and Q2 (91*b*) are connected in parallel to the series circuit, and a series circuit of adjusting resistors R2 and R3 is connected to the light-receiving portions Q1 and Q2. On the sensor substrate 95, therefore, the sum of the outputs of the pair of light-receiving portions 90*b* and 91*b* is obtained and is output.

The apparatus side is provided with an averaging circuit 96*a* which receives the sum of the outputs of the light-receiving portion pair 90*b* and 91*b* and obtains an integral of the sum over time, and a comparator 96*b* , which compares the output of the averaging circuit 96*a* with the set voltage and generates a toner empty signal when the output of the averaging circuit 96*a* becomes equal to or less than a set voltage.

Referring now to FIGS. 20A, 20B and 21, the operation will be described.

As shown in FIGS. 20A and 20B, when the amount of toner in the storage room 5*b* becomes small, the shape of a lump of the toner varies in accordance with the rotation of the agitator 54 and the toner lump moves due to the fluidity of the toner. Accordingly, the toner lump moves unstably and becomes as shown in FIG. 20A or FIG. 20B.

If the toner is detected at different positions by means of the two transmission photosensors 90 and 91, the average of the change in the toner lump can be detected. That is, in the state of FIG. 20B, the average of the change in the toner lump can be detected by the sum (indicated by the lower solid line in FIG. 21) of the output of the sensor 90 (indicated by the upper broken line in FIG. 21) and the output of the sensor 91 (indicated by the upper solid line in FIG. 21) as shown in FIG. 21, thus improving the detection accuracy.

Similarly, if the toner cannot be detected by the sensor 91 as shown in FIG. 20A, the toner can be detected by the sensor 90 so that the average of a varying toner lump can be detected.

If the positions of the transmission photosensors 90 and 91 are changed in the direction of the diameter of the agitator 54, toner detection can be accomplished even in the case where the toner lump becomes flat at the bottom of the storage room 5*b* and the toner lump stands up as it is pushed by the agitator 54 as shown in FIG. 20A.

As the detection is carried out at two different positions, the detection can be executed without being affected by a scratch or stain, if present, on the window portions of the sensor retainers 59*a* and 59*b*.

FIG. 22 illustrates the relationship between the positions of the retainers 59*a* and 59*b* for the transmission photosensors and sheets. When all the sheets, A3 size, B4 size and A4 size, are aligned on the right-hand end, the amount of toner consumption on the right-hand side of the developing unit 5 is greater than that on the left-hand side. Therefore, the amount of the toner in the right-hand portion matters most, so that the positions of the retainers 59*a* and 59*b* for the transmission photosensors are set rightward in the storage room 5*b*.

Likewise, when all the sheets are aligned on the left-hand end, the positions of the retainers 59*a* and 59*b* for the transmission photosensors are set leftward in the storage room 5*b*. With the sheets center-aligned, the positions of the retainers 59*a* and 59*b* for the transmission photosensors are set in the center in the storage room 5*b*.

By detecting the toner with the transmission photosensors at a plurality of positions in the toner storage room 5*b* in the above manner, for a small amount of the toner, the average of the moving toner can be detected and erroneous detection originating from the shape of part of the toner can be prevented, thus improving the detection accuracy.

Figure 23:
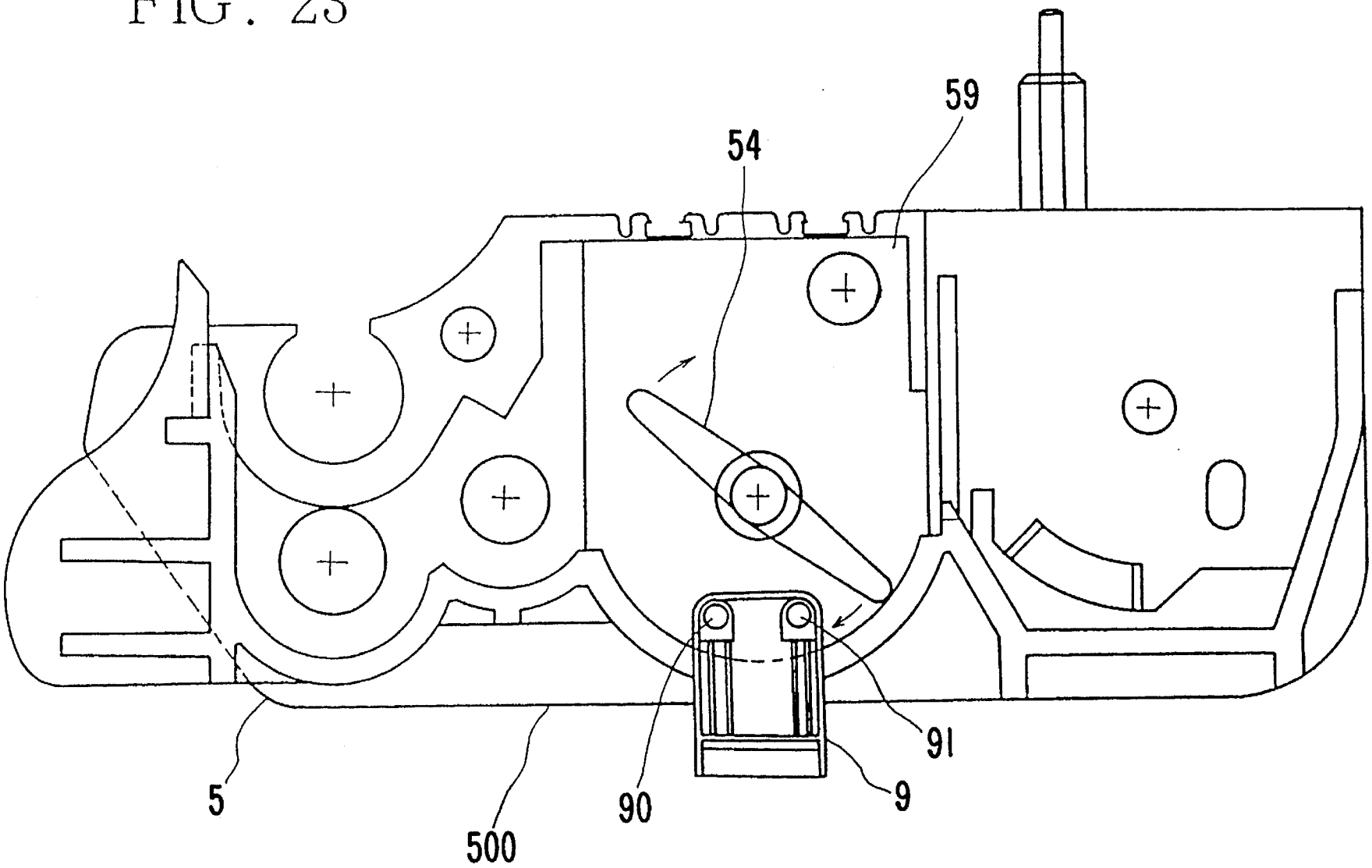
FIG. 23 is a diagram for explaining a modification of the toner sensor.

FIG. 23 is an explanatory diagram for a modification of the toner sensor.

In this embodiment, the positions of the two transmission photosensors 90 and 91 are shifted in the right and left directions. It is to be noted that the sensors 90 and 91 are positioned at the same distance with respect to the direction of the diameter of the agitator 54. In this modification, since the toner is also detected at a plurality of positions, the toner detection can be averaged.

The present invention is not limited to the above embodiment, but may by way of example be modified in various manners. First, sheets are not limited to paper but other types of media can also be used. Secondly, although the image forming apparatus has been explained as a printer, it may be a different type of image forming apparatus, such as a copying machine or facsimile. Thirdly, although the abutting/detaching mechanism has been described to have a structure as shown in FIGS. 11 through 13, it may have a different structure as well. Fourthly, the photosensitive body is not limited to a drum type, but may be of an endless type, such as an endless belt type. Further, the charging means is not limited to a charging roller, but may be a corotron or the like. Fifthly, although two transmission photosensors are provided in the above embodiment, three or more transmission photosensors may be provided as needed. Sixthly, a toner sensor is provided as a separate unit from the developing unit, it may be provided in the developing unit.

What is claimed is:

1. An image forming apparatus for one-component toner, comprising:

an endless latent image carrier;

an image forming unit for forming an electrostatic latent image on the latent image carrier;

a developing unit having a developing roller for supplying the one-component toner to the latent image carrier and a supplying member for supplying the one-component toner to the developing roller, causing the developing roller to contact the latent image carrier to develop the electrostatic latent image on the latent image carrier;

a developing unit driving mechanism for driving the developing unit;

a toner sensor for detecting the presence/absence of one-component toner in the developing unit;

an abutting/detaching mechanism for abutting/detaching the developing roller of the developing unit on or from the latent image carrier; and a controller for executing an image forming mode to control image formation by causing the abutting/detaching mechanism to abut the developing roller on the latent image carrier and driving the developing unit driving mechanism in response to an image forming instruction, and a developer supply mode for, with the developing roller before accepting the image forming instruction, set apart from the latent image carrier, driving the developing-unit driving mechanism to supply the one-component toner to the developing roller in accordance with an output of the toner sensor indicting an insufficient amount of the toner.

2. The image forming apparatus according to claim 1, wherein the controller performs control in such a way that a driving speed of the developing-unit driving mechanism in the developer supply mode is faster than that in the image forming mode.

3. The image forming apparatus according to claim 2, wherein when the controller reads the output of the toner sensor and detects presence of a toner during execution of the developer supply mode, the controller stops driving the developing-unit driving mechanism and permits reception of the image forming instruction.

4. The image forming apparatus according to claim 3, wherein when the controller does not detect presence of a toner from the output of the toner sensor within a predetermined period of time from beginning of the driving of the developing-unit driving mechanism during execution of the developer supply mode, the controller stops driving the developing-unit driving mechanism and permits reception of the image forming instruction.

5. The image forming apparatus according to claim 4, wherein the controller stops driving the developing-unit driving mechanism and indicates toner shortage.

6. The image forming apparatus according to claim 3, wherein the controller executes the developer supply mode when power of the apparatus is given.

7. The image forming apparatus according to claim 3, wherein an exchangeable toner cassette for retaining a one-component toner is detachably attached to the developing unit; and the controller executes the developer supply mode upon reception of an instruction representing that exchange of the toner cassette has been completed.

8. The image forming apparatus according to claim 1, wherein when the controller reads the output of the toner sensor and detects presence of a toner during execution of the developer supply mode, the controller stops driving the developing-unit driving mechanism and permits reception of the image forming instruction.

9. The image forming apparatus according to claim 8, wherein when the controller does not detect presence of a toner from the output of the toner sensor within a predetermined period of time from beginning of the driving of the developing-unit driving mechanism during execution of the developer supply mode, the controller stops driving the developing-unit driving mechanism and permits reception of the image forming instruction.

10. The image forming apparatus according to claim 9, wherein the controller stops driving the developing-unit driving mechanism and indicates toner shortage.

11. The image forming apparatus according to claim 8, wherein the controller executes the developer supply mode when power of the apparatus is given.

12. The image forming apparatus according to claim 8, wherein an exchangeable toner cassette for retaining a one-component toner is detachably attached to the developing unit; and the controller executes the developer supply mode upon reception of an instruction representing that exchange of the toner cassette has been completed.

13. The image forming apparatus according to claim 2, wherein when the controller does not detect presence of a toner from the output of the toner sensor within a predetermined period of time from beginning of the driving of the developing-unit driving mechanism during execution of the developer supply mode, the controller stops driving the developing-unit driving mechanism and permits reception of the image forming instruction.

14. The image forming apparatus according to claim 13, wherein the controller stops driving the developing-unit driving mechanism and indicates toner shortage.

15. The image forming apparatus according to claim 2, wherein the controller executes the developer supply mode when power of the apparatus is given.

16. The image forming apparatus according to claim 2, wherein an exchangeable toner cassette for retaining a one-component toner is detachably attached to the developing unit; and the controller executes the developer supply mode upon reception of an instruction representing that exchange of the toner cassette has been completed.

17. The image forming apparatus according to claim 1, wherein when the controller does not detect presence of a toner from the output of the toner sensor within a predetermined period of time from beginning of the driving of the developing-unit driving mechanism during execution of the developer supply mode, the controller stops driving the developing-unit driving mechanism and permits reception of the image forming instruction.

18. The image forming apparatus according to claim 17, wherein the controller stops driving the developing-unit driving mechanism and indicates toner shortage.

19. The image forming apparatus according to claim 1, wherein the controller executes the developer supply mode when power of the apparatus is given.

20. The image forming apparatus according to claim 1, wherein an exchangeable toner cassette for retaining a one-component toner is detachably attached to the developing unit; and the controller executes the developer supply mode upon reception of an instruction representing that exchange of the toner cassette has been completed.

21. An image forming apparatus for one-component toner, comprising:

an endless latent image carrier;

an image forming unit for forming an electrostatic latent image on the latent image carrier;

a developing unit having a developing roller for supplying the one-component toner to the latent image carrier and a rotational supplying member for supplying the one-component toner to the developing roller, for causing the developing roller to contact the latent image carrier to develop the electrostatic latent image on the latent image carrier;

a developing-unit driving mechanism for driving the developing unit;

a toner sensor including a plurality of transmission photosensors provided below a storage room retaining the rotational supplying member in the developing unit, for detecting the presence/absence of the one-component toner in the developing unit;

an abutting/detaching mechanism for abutting or detaching the developing roller of the developing unit on or from the latent image carrier;

a discriminating circuit for discriminating toner empty from a sum of outputs of the plurality of transmission photosensors; and a controller for controlling the abutting/detaching mechanism and the developing-unit driving mechanism in response to an image forming instruction, wherein the plurality of photosensors are located at different positions in the storage room;

a case for retaining the plurality of photosensors; and a case retainer, provided in the storage room of the developing unit, for retaining the case.

22. The image forming apparatus according to claim 21, wherein the discriminating circuit includes:

an averaging circuit for averaging a sum of the outputs of the plurality of transmission photosensors; and a comparator for comparing an output value of the averaging circuit and a predetermined set value and generating a toner empty signal.

23. An image forming apparatus for one-component toner, comprising:

an endless latent image carrier;

an image forming unit for forming an electrostatic latent image on the latent image carrier;

a developing unit having a developing roller for supplying the one component toner to the latent image carrier and a rotational supplying member for supplying the one-component toner to the developing roller, for causing the developing roller to contact the latent image carrier to develop the electrostatic latent image on the latent image carrier;

a developing-unit driving mechanism for driving the developing unit;

a toner sensor including a plurality of transmission photosensors provided below a storage room retaining the rotational supplying member in the developing unit, for detecting the presence/absence of the one-component toner in the developing unit;

an abutting/detaching mechanism for abutting/detaching the developing roller of the developing unit on or from the latent image carrier;

a discriminating circuit for discriminating toner empty from a sum of outputs of the plurality of transmission photosensors;

a controller for controlling the abutting/detaching mechanism and the developing-unit driving mechanism in response to an image forming instruction;

a case for retaining the plurality of photosensors; and a case retainer provided in the storage room of the developing unit for retaining the case.

* * * * *

UNITED STATES PATENT AND TRADEMARK OFFICE

CERTIFICATE OF CORRECTION

PATENT NO. : 5,530,528

DATED : June 25, 1996

INVENTOR(S) : Yoji HOUKI, et al.

It is certified that error appears in the above-indentified patent and that said Letters Patent is hereby corrected as shown below:

Column 12, line 54, start new paragraph wiht "IF".

Signed and Sealed this

Twenty-second Day of October, 1996

*Attest:*

Bruce Lehman

BRUCE LEHMAN

*Attesting Officer*

*Commissioner of Patents and Trademarks*